US007488351B2

(12) United States Patent
Jones, Jr.

(10) Patent No.: US 7,488,351 B2
(45) **Date of Patent: *Feb. 10, 2009**

(54) METHODS OF TREATING AND CLEANING FIBERS, CARPET YARNS AND CARPETS

(75) Inventor: Dennis J. Jones, Jr., Signal Mountain, TN (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/842,769

(22) Filed: Aug. 21, 2007

(65) Prior Publication Data

US 2008/0047077 A1 Feb. 28, 2008

Related U.S. Application Data

(60) Continuation of application No. 11/007,840, filed on Dec. 8, 2004, now Pat. No. 7,276,085, which is a division of application No. 10/627,945, filed on Jul. 24, 2003.

(51) Int. Cl.
*D06M 13/238* (2006.01)
*D06M 11/26* (2006.01)

(52) U.S. Cl. ..... 8/115.56; 8/115.6; 8/115.68; 252/8.62

(58) Field of Classification Search ..... 8/115.56, 8/115.6, 115.68; 252/8.62
See application file for complete search history.

(56) References Cited

U.S. PATENT DOCUMENTS

| | | | |
|---|---|---|---|
| 2,480,775 | A | 8/1949 | Ryan |
| 3,322,554 | A | 5/1967 | Wyss et al. |
| 3,511,704 | A | 5/1970 | Wyss et al. |
| 3,606,989 | A | 9/1971 | Park |
| 3,625,754 | A | 12/1971 | Dunn |
| 3,632,421 | A | 1/1972 | Boyd et al. |
| 3,632,422 | A | 1/1972 | Maggiolo et al. |
| 3,639,290 | A | 2/1972 | Fearnley et al. |
| 3,649,165 | A | 3/1972 | Cotton |
| 3,652,212 | A | 3/1972 | Machell |
| 3,655,566 | A | 4/1972 | Robinson et al. |
| 3,666,680 | A | 5/1972 | Briggs |
| 3,669,611 | A | 6/1972 | Shimauchi et al. |
| 3,706,594 | A | 12/1972 | Wasley et al. |
| 3,799,992 | A | 3/1974 | Pittman et al. |
| 3,816,167 | A | 6/1974 | Schultz et al. |
| 3,816,229 | A | 6/1974 | Bierbrauber |
| 3,857,757 | A | 12/1974 | Benisek |
| 3,885,911 | A | 5/1975 | Habib |
| 3,912,681 | A | 10/1975 | Dickson |
| 3,916,053 | A | 10/1975 | Sherman et al. |
| 3,920,389 | A | 11/1975 | Eanzel |
| 3,948,838 | A | 4/1976 | Hinton, Jr. et al. |
| 3,961,881 | A | 6/1976 | Sumner et al. |
| 3,993,830 | A | 11/1976 | Dickson et al. |
| 3,999,940 | A | 12/1976 | Freeman |
| 4,043,964 | A | 8/1977 | Sherman et al. |
| 4,052,158 | A | 10/1977 | Weil |
| 4,071,463 | A | 1/1978 | Steinhauer |
| 4,076,631 | A | 2/1978 | Caruso et al. |
| 4,081,383 | A | 3/1978 | Warburton, Jr. et al. |
| 4,087,394 | A | 5/1978 | Concannon |
| 4,094,701 | A | 6/1978 | Fekete |
| 4,144,367 | A | 3/1979 | Landucci |
| 4,203,859 | A | 5/1980 | Kirn et al. |
| 4,208,173 | A | 6/1980 | Gregorian et al. |
| 4,245,994 | A | 1/1981 | Lipowski |
| 4,264,484 | A | 4/1981 | Patel |
| 4,293,600 | A | 10/1981 | Fink et al. |
| 4,295,976 | A | 10/1981 | Dessaint et al. |
| 4,325,857 | A | 4/1982 | Champaneria |
| 4,340,749 | A | 7/1982 | Patel |
| 4,351,736 | A | 9/1982 | Steinberger et al. |
| 4,355,065 | A | 10/1982 | DeMott |
| 4,382,798 | A | 5/1983 | Suzuki et al. |
| 4,388,205 | A | 6/1983 | Stettler et al. |
| 4,426,476 | A | 1/1984 | Chang |
| 4,501,591 | A | 2/1985 | Ucci et al. |
| 4,592,940 | A | 6/1986 | Blyth et al. |
| 4,680,212 | A | 7/1987 | Blyth et al. |
| 4,699,812 | A | 10/1987 | Munk et al. |

(Continued)

FOREIGN PATENT DOCUMENTS

| | | |
|---|---|---|
| EP | 0 261 637 | 3/1988 |

(Continued)

OTHER PUBLICATIONS

Baxley and Miller. (1991) Effects of suessen heat setting variables on streaks in finished nylon carpet. Textile Res. J., 61(12): 697-704.

(Continued)

*Primary Examiner*—Lorna M Douyon
*Assistant Examiner*—Amina Khan
(74) *Attorney, Agent, or Firm*—Ballard Spahr Andrews & Ingersoll, LLP

(57) ABSTRACT

Methods of enhancing stain resistance of fibers, carpet yarns and carpets are disclosed. Treating compositions used to enhance the stain resistance of fibers, carpet yarns and carpets are also disclosed.

19 Claims, No Drawings

U.S. PATENT DOCUMENTS

| | | | | |
|---|---|---|---|---|
| 4,780,099 | A | | 10/1988 | Greschler et al. |
| 4,781,844 | A | | 11/1988 | Kortmann et al. |
| 4,800,118 | A | | 1/1989 | Reed et al. |
| 4,822,373 | A | | 4/1989 | Olsen et al. |
| 4,833,009 | A | | 5/1989 | Marshall |
| 4,842,646 | A | | 6/1989 | Gamblin |
| 4,865,885 | A | | 9/1989 | Herlant et al. |
| 4,875,901 | A | | 10/1989 | Payet et al. |
| 4,883,839 | A | | 11/1989 | Fitzgerald et al. |
| 4,892,558 | A | * | 1/1990 | Blyth et al. ..... 8/560 |
| 4,908,149 | A | | 3/1990 | Moore et al. |
| 4,925,707 | A | | 5/1990 | Vinod |
| 4,937,123 | A | | 6/1990 | Chang et al. |
| 4,948,650 | A | | 8/1990 | Fitzgerald et al. |
| 5,001,004 | A | | 3/1991 | Fitzgerald et al. |
| 5,009,667 | A | | 4/1991 | Beck et al. |
| 5,032,136 | A | | 7/1991 | Fitzgerald et al. |
| 5,057,121 | A | | 10/1991 | Fitzgerald et al. |
| 5,073,442 | A | | 12/1991 | Knowlton et al. |
| 5,074,883 | A | | 12/1991 | Wang |
| 5,108,684 | A | | 4/1992 | Anton et al. |
| 5,110,317 | A | | 5/1992 | Hangey et al. |
| 5,126,138 | A | | 6/1992 | McGee et al. |
| 5,131,909 | A | | 7/1992 | Hangey |
| 5,131,914 | A | | 7/1992 | Kelley |
| 5,137,759 | A | | 8/1992 | Vinod |
| 5,145,487 | A | | 9/1992 | Hangey et al. |
| 5,152,803 | A | | 10/1992 | Hangey et al. |
| 5,155,178 | A | | 10/1992 | Windley |
| 5,164,261 | A | | 11/1992 | Windley |
| 5,223,340 | A | | 6/1993 | Moss, III et al. |
| 5,229,483 | A | | 7/1993 | Fitzgerald |
| 5,230,708 | A | | 7/1993 | Hangey et al. |
| 5,232,743 | A | | 8/1993 | Calcaterra et al. |
| 5,234,466 | A | | 8/1993 | Sargent et al. |
| 5,242,733 | A | | 9/1993 | Windley |
| 5,252,232 | A | | 10/1993 | Vinod |
| 5,252,375 | A | | 10/1993 | Turbak et al. |
| 5,316,850 | A | | 5/1994 | Sargent et al. |
| 5,328,766 | A | | 7/1994 | Smith |
| 5,342,417 | A | | 8/1994 | Pacifici et al. |
| 5,348,785 | A | | 9/1994 | Vinod |
| 5,348,786 | A | | 9/1994 | Calcaterra et al. |
| 5,356,689 | A | | 10/1994 | Pechhold |
| 5,358,769 | A | | 10/1994 | Pechhold |
| 5,383,972 | A | | 1/1995 | Waltz |
| 5,401,554 | A | | 3/1995 | Armen |
| 5,403,362 | A | | 4/1995 | Gurley |
| 5,417,724 | A | | 5/1995 | Pacifici et al. |
| 5,436,049 | A | | 7/1995 | Hu |
| 5,447,755 | A | | 9/1995 | Pechhold et al. |
| 5,451,259 | A | | 9/1995 | Krogh |
| 5,457,259 | A | | 10/1995 | Elgarhy et al. |
| 5,459,188 | A | | 10/1995 | Sargent et al. |
| 5,460,887 | A | | 10/1995 | Pechhold |
| 5,460,891 | A | | 10/1995 | Buck et al. |
| 5,464,911 | A | | 11/1995 | Williiams et al. |
| 5,468,554 | A | | 11/1995 | Windley |
| 5,516,337 | A | | 5/1996 | Nguyen |
| 5,520,962 | A | | 5/1996 | Jones, Jr. |
| 5,522,580 | A | | 6/1996 | Varner, Jr. et al. |
| 5,545,833 | A | | 8/1996 | Stoddard |
| 5,549,963 | A | | 8/1996 | Elgarhy et al. |
| 5,558,916 | A | | 9/1996 | Helm et al. |
| 5,560,992 | A | | 10/1996 | Sargent et al. |
| 5,571,444 | A | | 11/1996 | Fisher et al. |
| 5,571,551 | A | | 11/1996 | Fusi et al. |
| 5,574,106 | A | | 11/1996 | Allen |
| 5,616,151 | A | | 4/1997 | Sargent et al. |
| 5,618,604 | A | | 4/1997 | Dohn |
| 5,639,500 | A | | 6/1997 | Fusi et al. |
| 5,654,068 | A | | 8/1997 | Pechhold |
| 5,662,716 | A | | 9/1997 | Sun |
| 5,669,937 | A | | 9/1997 | McBride et al. |
| 5,670,246 | A | | 9/1997 | Pechhold et al. |
| 5,672,674 | A | | 9/1997 | Walz et al. |
| 5,681,604 | A | | 10/1997 | Li et al. |
| 5,708,087 | A | | 1/1998 | Buck et al. |
| 5,725,889 | A | | 3/1998 | Buck |
| 5,736,468 | A | | 4/1998 | Elgarhy |
| 5,738,688 | A | * | 4/1998 | De Lathauwer ..... 8/115.56 |
| 5,750,445 | A | | 5/1998 | Pechhold et al. |
| 5,770,656 | A | | 6/1998 | Pechhold |
| 5,821,177 | A | | 10/1998 | Elgarhy |
| 5,824,372 | A | | 10/1998 | Pechhold |
| 5,830,572 | A | | 11/1998 | Anton et al. |
| 5,851,595 | A | | 12/1998 | Jones, Jr. |
| 5,853,814 | A | | 12/1998 | Murphy |
| 5,906,877 | A | | 5/1999 | Popper et al. |
| 5,939,166 | A | | 8/1999 | Cheng et al. |
| 5,948,480 | A | | 9/1999 | Murphy |
| 5,965,232 | A | | 10/1999 | Vinod |
| 6,013,732 | A | | 1/2000 | Yamana et al. |
| 6,023,823 | A | | 2/2000 | Yeh et al. |
| 6,024,770 | A | | 2/2000 | De Lathauwer |
| 6,071,869 | A | | 6/2000 | Materniak et al. |
| 6,074,436 | A | | 6/2000 | Wang et al. |
| 6,098,392 | A | | 8/2000 | Tung |
| 6,117,550 | A | | 9/2000 | Studholme |
| 6,197,378 | B1 | | 3/2001 | Clark et al. |
| 6,207,594 | B1 | | 3/2001 | Elgarhy |
| 6,238,792 | B1 | | 5/2001 | Pechold et al. |
| 6,300,299 | B1 | | 10/2001 | Murphy et al. |
| 6,309,471 | B1 | | 10/2001 | Smith et al. |
| 6,387,448 | B1 | | 5/2002 | Collier et al. |
| 6,395,655 | B1 | | 5/2002 | Elgarhy |
| 6,420,044 | B1 | | 7/2002 | Studholme |
| 6,443,998 | B1 | | 9/2002 | Jones |
| 6,458,443 | B2 | | 10/2002 | Collier et al. |
| 6,482,895 | B2 | | 11/2002 | Maugans et al. |
| 6,482,896 | B2 | | 11/2002 | Maugans et al. |
| 6,488,893 | B1 | | 12/2002 | Elgarhy et al. |
| 6,524,492 | B2 | | 2/2003 | Williams et al. |
| 6,613,862 | B2 | | 9/2003 | Clark et al. |
| 6,616,856 | B1 | | 9/2003 | Pacifici et al. |
| 6,635,346 | B2 | | 10/2003 | Studholme |
| 6,635,347 | B1 | | 10/2003 | Yoshida |
| 6,719,810 | B1 | | 4/2004 | Kelly et al. |
| 6,740,357 | B2 | | 5/2004 | Yamaguchi et al. |
| 6,790,905 | B2 | | 9/2004 | Fitzgerald et al. |
| 6,793,684 | B1 | | 9/2004 | Jarvis et al. |
| 6,811,574 | B2 | | 11/2004 | Baumann et al. |
| 6,814,758 | B1 | | 11/2004 | Pacifici et al. |
| 6,814,881 | B2 | | 11/2004 | Elgarhy |
| 6,818,253 | B2 | | 11/2004 | Kimbrell |
| 6,833,082 | B2 | | 12/2004 | Yamaguchi et al. |
| 6,852,134 | B2 | | 2/2005 | Baumann et al. |
| 6,860,905 | B2 | | 3/2005 | Williams et al. |
| 7,115,224 | B2 | | 10/2006 | Studholme |
| 7,147,669 | B2 | | 12/2006 | Yamaguchi et al. |
| 7,147,928 | B2 | | 12/2006 | Collier et al. |
| 7,157,121 | B2 | | 1/2007 | Jones, Jr. |
| 7,276,085 | B2 | * | 10/2007 | Jones, Jr. ..... 8/115.56 |
| 7,279,013 | B2 | | 10/2007 | Elgarhy |
| 7,311,959 | B2 | | 12/2007 | Jones, Jr. |
| 7,335,234 | B2 | | 2/2008 | Jones, Jr. |
| 2001/0027581 | A1 | | 10/2001 | Sun |
| 2001/0046583 | A1 | | 11/2001 | Wilson et al. |
| 2001/0052154 | A1 | | 12/2001 | Kelly et al. |
| 2002/0005250 | A1 | | 1/2002 | Jerdee et al. |
| 2003/0015282 | A1 | | 1/2003 | Reisdorf et al. |
| 2004/0123398 | A1 | | 7/2004 | Baumann et al. |
| 2004/0123399 | A1 | | 7/2004 | Baumann et al. |
| 2004/0138083 | A1 | | 7/2004 | Kimbrell, Jr. et al. |

2004/0144406 A1 7/2004 Garabedian et al.
2004/0152840 A1 8/2004 Studholme

FOREIGN PATENT DOCUMENTS

| | | | |
|---|---|---|---|
| GB | 1 254 541 | | 11/1971 |
| GB | 1254541 | * | 11/1971 |
| JP | 36 22937 | | 11/1961 |
| JP | 47 32185 | | 11/1972 |
| JP | 49 19191 | | 2/1974 |
| JP | 58 154 772 | | 9/1983 |
| JP | 60 110977 | | 6/1985 |
| JP | 62 238 887 | | 3/1986 |
| JP | 61 174 485 | | 8/1986 |
| JP | 61 252 383 | | 11/1986 |
| JP | 62 263389 | | 11/1987 |
| JP | 64 68575 | | 3/1989 |
| JP | 35 00189 | | 1/1991 |
| JP | 35 00307 | | 1/1991 |
| JP | 5 214627 | | 8/1993 |
| JP | 214626 | | 8/1993 |
| JP | 6 2286 | | 1/1994 |
| WO | WO 95/009266 | | 4/1995 |
| WO | WO 95/021955 | | 8/1995 |
| WO | WO 00/029664 | | 5/2000 |
| WO | WO 02/072942 | | 9/2002 |

OTHER PUBLICATIONS

Cook et al. (1977) The effect of some aromatic hydroxyl compounds on the absorption of anionic dye by nylon 6. Textile Res. J., 47(244): 244-49.
DuPont Filaments, Conditioning Nylon Filaments, Technical Information.
Gupta et al. (2000) Dye-uptake behaviour of nylon-6 filaments and its structural dependence. JSDC, 116: 385-90.
Harris and Hangey. (1989) Stain resist chemistry for nylon-6 carpet. SAC Synthesis, 21(11): 25-30.
http://am1.arizona.edu/classes/mse222/1998/nylon66/mse22.htm.
http://www.apparelsearch.com/
education_reserach_nonwoven_nylon_fiber.htm.
Ogasawara et al. (1982) Studies on the mechanism of dye fixation. Part 10. Effect of after treatment with tannic acid on the fixation of disperse, acid, direct and basic dyes. Textiles, 7: 73.
Rodger and Lee. (1991) Structural Properties of Nylon 66 Carpet yarns observed with near infrafed analysis. Textile Res. J., 61(9): 531-36.
Rollins et al. (1998) Thermal mechanical analysis (TMA) and yarn shrinkage as methods to determine heat set temperature in nylon. American Dyestuff Reporter, 36-41.
Sichina. (2000) Detection of Heat set temperatures of nylon 66 carpet yarns by DSC. Perkin Elmer instruments, available at http://www.Perkingelmer.com.
Tincher et al. (1996) Characterization of heat set nylon carpet yarn. Applications of NIRS, 18(2): 25-30.
Trotman, Dyeing and chemical technology of textiles fibers, 6th edition, 474-478, 480 (1984).
U.S. Appl. No. 10/627,945, filed Jul. 24, 2003, D. Jones, Appeal Brief Filed, Feb. 14, 2008.
U.S. Appl. No. 10/627,945, filed Jul. 24, 2003, D. Jones, Miscellaneous Action with SSP, Jan. 22, 2008.
U.S. Appl. No. 10/627,945, filed Jul. 24, 2003, D. Jones, Appeal Brief Filed, Jan. 2, 2008.
U.S. Appl. No. 10/627,945, filed Jul. 24, 2003, D. Jones, Decision re Request for Pre-Brief Conference, Oct. 2, 2007.
U.S. Appl. No. 10/627,945, filed Jul. 24, 2003, D. Jones, Request for Pre-Brief Conference, Aug. 20, 2007.
U.S. Appl. No. 10/627,945, filed Jul. 24, 2003, D. Jones, Notice of Appeal, Aug. 20, 2007.
U.S. Appl. No. 10/627,945, filed Jul. 24, 2003, D. Jones, Final Rejection, May 17, 2007.
U.S. Appl. No. 10/627,945, filed Jul. 24, 2003, D. Jones, Response to O.A. dated Oct. 4, 2006, Feb. 22, 2007
U.S. Appl. No. 10/627,945, filed Jul. 24, 2003, D. Jones, §1.132 Declaration of Dennis J. Jones, Jr. Feb. 22, 2007.
U.S. Appl. No. 10/627,945, filed Jul. 24, 2003, D. Jones, Non-Final Rejection, Oct. 4, 2006.
U.S. Appl. No. 60/627,945, filed Jul. 24, 2003, D. Jones, Request for Continued Examination and Response to O.A. dated Jun. 13, 2006, Sep. 5, 2006.
U.S. Appl. No. 10/627,945, filed Jul. 24, 2003, D. Jones, Final Rejection, Jun. 13, 2006.
U.S. Appl. No. 10/627,945, filed Jul. 24, 2003, D. Jones, Response to O.A. dated Jan. 11, 2006, Mar. 23, 2006.
U.S. Appl. No. 10/627,945, filed Jul. 24, 2003, D. Jones, Non-Final Rejection, Jan. 11, 2006.
U.S. Appl. No. 10/627,945, filed Jul. 24, 2003, D. Jones, Request for Continued Examination and Response to O.A. dated Jul. 27, 2005, Oct. 26, 2005.
U.S. Appl. No. 10/627,945, filed Jul. 24, 2003, D. Jones, Final Rejection, Jul. 27, 2005.
U.S. Appl. No. 10/627,945, filed Jul. 24, 2003, D. Jones, Request for Reconsideration in response to O.A. dated Dec. 17, 2004, Apr. 1, 2005.
U.S. Appl. No. 10/627,945, filed Jul. 24, 2003, D. Jones, Non-Final Rejection, Dec. 17, 2004.
U.S. Appl. No. 10/627,945, filed Jul. 24, 2003, D. Jones, Preliminary Amendment, Oct. 26, 2004.
U.S. Appl. No. 11/007,840, filed Dec. 8, 2004, D. Jones, Issue Notification, Sep. 12, 2007.
U.S. Appl. No. 11/007,840, filed Dec. 8, 2004, D. Jones, Examiner Interview Summary Record, May 21, 2007.
U.S. Appl. No. 11/007,840, filed Dec. 8, 2004, D. Jones, Notice of Allowance, May 21, 2007.
U.S. Appl. No. 11/007,840, filed Dec. 8, 2004, D. Jones, Amendment and Response to Non-Final Rejection, Feb. 22, 2007, Jan. 9, 2006.
U.S. Appl. No. 11/007,840, filed Dec. 8, 2004, D. Jones, Non-Final Rejection, Jan. 12, 2007.
U.S. Appl. No. 11/007,840, filed Dec. 8, 2004, D. Jones, Request for Continued Examination (RCE) with Amendment and Response, Sep. 5, 2006.
U.S. Appl. No. 11/007,840, filed Dec. 8, 2004, D. Jones, Final Rejection, May 4, 2006.
U.S. Appl. No. 11/007,840, filed Dec. 8, 2004, D. Jones, Response to Notice of Non-Compliant Amendment, Feb. 9, 2006.
U.S. Appl. No. 11/007,840, filed Dec. 8, 2004, D. Jones, Notice to the applicant regarding a non-compliant or non-responsive amendment, Jan. 27, 2006.
U.S. Appl. No. 11/007,840, filed Dec. 8, 2004, D. Jones, Amendment and Response to O.A. dated Oct. 7, 2005.
U.S. Appl. No. 11/007,840, filed Dec. 8, 2004, D. Jones, Non-Final Rejection, Oct. 7, 2005.
U.S. Appl. No. 11/007,840, filed Dec. 8, 2004, D. Jones, Preliminary Amendment, Dec. 8, 2004.
U.S. Appl. No. 11/041,390, filed Jan. 24, 2005, D. Jones, Final Rejection, Jun. 2, 2008.
U.S. Appl. No. 11/041,390, filed Jan. 24, 2005, D. Jones, Supplemental Response to O.A. dated Sep. 24, 2007, May 20, 2008.
U.S. Appl. No. 11/041,390, filed Jan. 24, 2005, D. Jones, Response to Notice of Non-Compliant Amendment dated Apr. 4, 2008, Apr. 21, 2008.
U.S. Appl. No. 11/041,390, filed Jan. 24, 2005, D. Jones, Notice of Non-Compliant Amendment, Apr. 4, 2008.
U.S. Appl. No. 11/041,390, filed Jan. 24, 2005, D. Jones, Response to Office Action dated Sep. 24, 2007, Mar. 24, 2008.
U.S. Appl. No. 11/041,390, filed Jan. 24, 2005, D. Jones, Non-Final Office Action, Sep. 24, 2007.
U.S. Appl. No. 11/041,390, filed Jan. 24, 2005, D. Jones, Response to Office Action and Election under Restriction Requirement dated Jun. 20, 2007, Jul. 17, 2007.
U.S. Appl. No. 11/041,390, filed Jan. 24, 2005, D. Jones, Response to Office Action dated Sep. 24, 2007, Mar. 24, 2008.
U.S. Appl. No. 11/041,390, filed Jan. 24, 2005, D. Jones, Requirement for Restriction/Election, Jun. 20, 2007.
U.S. Appl. No. 11/041,390, filed Jan. 24, 2005, D. Jones, Miscellaneous letter containing Affidavit of Frank Endrenyi, Mar. 22, 2007.

U.S. Appl. No. 11/041,390, filed Jan. 24, 2005, D. Jones, Preliminary Amendment, Mar. 24, 2005.
PCT/US2006/002432, filed Jan. 23, 2006, Shaw Industries Group, Inc., Written Opinion of the International Search Authority, Jul. 24, 2007.
PCT/US2006/002432, filed Jan. 23, 2006, Shaw Industries Group, Inc., International Preliminary Report on Patentability, Jul. 24, 2007.
PCT/US2006/002432, filed Jan. 23, 2006, Shaw Industries Group, Inc., International Search Report, Jun. 6, 2006.
U.S. Appl. No. 11/041,390, filed Dec. 2, 2008.
U.S. Appl. No. 10/627,945, filed Jul. 24, 2003.
U.S. Appl. No. 11/007,840, filed Dec. 8, 2004.

* cited by examiner

METHODS OF TREATING AND CLEANING FIBERS, CARPET YARNS AND CARPETS

CROSS-REFERENCE TO RELATED APPLICATIONS

This application is a continuation of, and claims the benefit of, U.S. application Ser. No. 11/007,840, filed Dec. 8, 2004, now U.S. Pat. No. 7,276,085, which is a divisional of U.S. application Ser. No. 10/627,945, filed Jul. 24, 2003, which are hereby incorporated herein by reference in their entireties.

FIELD OF THE INVENTION

The present invention is directed to methods and compositions for treating fibers, and especially carpet yarns and carpets that include nylon fibers. The present invention is further directed to methods for cleaning fibers, carpet yarns and carpets.

BACKGROUND OF THE INVENTION

In the last two decades, there has been considerable interest in developing treatments for carpet fibers, particularly nylon carpet fibers, to enhance repellency and stain resistance. A number of treatments have been developed that provide enhances repellency and stain resistance to nylon carpet yarns; however, the stain and soil resistant treatments can be removed from the fiber by high pH cleaning solutions, and in some cases, the protective materials on the fiber can produce discoloration when high pH cleaning solutions (i.e., cleaning solutions having a pH of greater that about 7.5) are applied to the treated yarns. High pH cleaning solutions, such as dilute caustic soda solutions or ammonia-containing solutions, are not normally suggested for use in direct general cleaning of carpets, but these materials may be accidentally spilled onto the carpet when associated areas, such as tile flooring, are cleaned.

There is a continued need in the art to develop methods of providing stain resistance to fibers, carpet yarns and carpets, and especially, methods of providing stain resistance to fibers, carpet yarns and carpets, which do not react negatively with post-treatment cleaning solutions. Further, there is a need in the art for a method of cleaning fibers, carpet yarns and carpets, wherein the cleaning method uses a high pH cleaning solution to provide superior cleaning, but does not negatively impact the coloration, or the performance parameters of the cleaned fibers, carpet yarns or carpets.

SUMMARY OF THE INVENTION

The present invention addressed some of the difficulties and problems discussed above by the discovery of a method of treating fibers, and especially carpet yarns, to enhance the stain resistance of the fibers and carpet yarns. The method provides a desired amount of exhaustion of an aqueous treating composition onto and into the fiber or carpet yarn. In one exemplary embodiment of the present invention, the method comprises contacting a fiber, carpet yarn or carpet with one or more aqueous treating compositions, wherein the one or more aqueous treating compositions comprise at least one crosslinking agent selected from the group consisting of antimony potassium tartrate (APT), stannous chloride, and a combination thereof. In a further exemplary embodiment of the present invention, the method comprises contacting a fiber, carpet yarn or carpet with one or more aqueous treating compositions, wherein the one or more aqueous treating compositions comprise tannic acid, at least one crosslinking agent, and an acid stain-blocking agent.

In yet a further exemplary embodiment of the present invention, the method of treating a fiber, yarn or carpet comprises applying an aqueous treating composition to the fiber, yarn or carpet, wherein the aqueous treating composition comprises stannous chloride alone or in combination with one or more optional components.

The method of treating fibers, yarns or carpets may comprise one or more applications steps, as well as, additional steps, such as heating steps, fixing steps, rinsing steps, and drying steps. For example, the step of applying one or more aqueous treating compositions to the fiber, yarn or carpet may comprise (i) applying a first aqueous treating composition comprising tannic acid to form a coated fiber; (ii) forming a fixed coated fiber by exposing the coated fiber to heat for a sufficient time to fix the tannic acid on and in the fiber; and (iii) forming an overcoated fiber by applying a second aqueous treating composition to the fixed coated fiber, wherein the second aqueous treating composition comprises stannous chloride, and, optionally, a fluorochemical component.

The coated carpet yarn is desirably heated to fix one or more components, such as tannic acid, a stain blocker, and/or a crosslinking agent, onto the fiber, yarn or carpet, and then rinsed with water and dried to produce a stain-resistant carpet yarn, which may be cleaned using a variety of high pH cleaning solutions without negatively impacting the color and/or shade of the carpet yarn.

The present invention is further directed to aqueous treating compositions for treating fibers, carpet yarns and carpets to enhance the repellency and stain-resistance of the fibers, carpet yarns and carpets. In one exemplary embodiment of the present invention, the aqueous treating composition comprises at least one crosslinking agent and one or more additional components selected from tannic acid; at least one pH adjuster, such as an acid; at least one additional stain-resist compound; at least one fluorochemical compound; at least one dye; one or more dyebath components; and mixtures thereof. In a further exemplary embodiment, the aqueous treating composition comprises tannic acid and at least one crosslinking agent, and optionally further comprises one or more components selected from at least one pH adjuster, such as an acid; at least one additional stain-resist compound; at least one fluorochemical compound; at least one dye; one or more dyebath components; and mixtures thereof.

The present invention is even further directed to treated fibers, carpet yarns and carpets having enhanced stain-resistance and resistance to discoloration upon contact with high pH cleaning solutions. The treated fibers, carpet yarns and carpets of the present invention have a desired degree of resistance to discoloration when exposed to a variety of staining materials, such as a caustic solution, an ammonia solution, an acid red dye-containing solution, and a mustard-containing solution.

The present invention is also directed to a method of cleaning fibers, carpet yarns or carpets. The method comprises contacting a fiber, carpet yarn or carpet with a high pH cleaning solution to clean the fiber, carpet yarn or carpet, wherein the contacting step does not negatively impact the coloration or the performance characteristics of the fiber, carpet yarn or carpet. The high pH cleaning solution may have a pH of greater than 7.5, and in some cases, greater than 9.5.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Various types of fibers and carpet yarns can be treated according to the present invention. Desirably, the method of the present invention is used to treat carpet, namely carpet yarn tufted into a backing material. Alternatively, the carpet yarn or fiber may be treated according to the method of the present invention prior to being tufted into a backing material.

Throughout the description of the present invention, a number of terms are used to describe aspects of the present invention. As used herein, the term "repellency" is intended to have a relatively broad meaning, referring to a reduced tendency for soil, oil and/or water to adhere to the carpet fibers. As used herein, the term "stain-resistance" is also intended to have a relatively broad meaning, referring to a reduced tendency of the carpet fibers to be stained by dyes, such as acid dyes, disperse dyes, and/or metal-complex dyes.

I. Fibers, Carpet Yarns and Carpets

The present invention may be practiced using a variety of fibers and carpet yarns formed from fibers. Typically; the carpet yarn comprises an extruded synthetic polymer, such as nylon, polyester, polypropylene, or a combination thereof. Alternatively, the carpet yarn may be made from natural fibers, such as wool or cotton, or a combination of natural fibers and synthetic fibers. Desirably, the carpet yarn comprises, either in whole or in part, extruded fibers of nylon 6, nylon 6,6, or other polyamide chemical structures.

The present invention may be practiced using fibers and carpet yarns containing one or more colorants, or fibers and carpet yarns substantially free of added colorants. Suitable colorants include, but are not limited to, dyes, pigments, or any other color-producing material. When using colored fibers or yarns, the color typically results from a dye treatment or from a melt extrusion process (i.e., dyes or pigments are incorporated into the fiber during an extrusion process).

The extruded fibers may be made into yarn by various conventional means. Desirably, the yarn is a bulk continuous filament yarn, which is heat-set by conventional means, such as the Superba or the Suessen method. Alternatively, the yarn may be a staple spun yarn. Desirably, the yarn is not pretreated with a fluorochemical by the yarn manufacturer, although fibers that have been pre-treated with a fluorochemical by the fiber manufacturer may be useful in the present invention.

In one embodiment of the present invention, the carpet yarn is already tufted by conventional means into a carpet structure prior to being treated by the method of the present invention. The stitch pattern and density of the tufted carpet do not appear to be critical factors in the practice of the present invention.

II. Treating Compositions for Fibers, Carpet Yarns and Carpets

The aqueous treating compositions of the present invention contain one or more of the following components.

A. Water

The aqueous treating compositions of the present invention comprise water as a primary solvent or carrier. Soft or hard water may be used in the present invention, although soft water is more desirable. As used herein, the term "soft water" refers to water containing less than about 60 ppm of calcium carbonate. As used herein, the term "hard water" refers to water containing more than about 60 ppm of calcium carbonate, while "very hard water" refers to water containing more than about 180 ppm of calcium carbonate. The treating compositions of the present invention may be formed using water available from any municipal water-treatment facility.

The treating compositions of the present invention typically comprise greater than about 90 parts by weight (pbw) of water based on a total weight of the treating composition. Desirably, the treating compositions of the present invention comprise from about 90 to about 99.9 pbw water based on a total weight of the treating composition. More desirably, the treating compositions of the present invention comprise from about 98 to about 99.5 pbw water based on a total weight of the treating compositions.

B. Tannic Acid

The aqueous treating compositions of the present invention may comprise at least one tannic acid. Tannic acids are well known in the art and comprise compounds derived from nutgalls having a structure of polygalloylglucose or polygalloylqulinic acid. The term "tannic acid" as used herein refers to tannic acids and products containing tannic acid, such as gallotannin. Suitable tannic acids for use in the present invention include, but are not limited to, tannic acids described in U.S. Pat. No. 5,738,688, the disclosure of which is hereby incorporated by reference in its entirety. Desirably, the tannic acid used in the present invention has a gallic acid content of less than about 3.0 parts by weight (pbw), more desirably, less than about 2.0 pbw, and even more desirably, less than about 1.0 pbw.

Several commercially available tannic acids are suitable for use in the present invention. Suitable tannic acids include, but are not limited to, tannic acid powders commercially available from Aceto Corporation (Lake Success, N.Y.) under the trade designations ASP powder and 3SP powder; tannic acid solution commercially available from Bayer Corporation (Baytown, Tex.) under the trade designation BAYGARD® CL Liquid; and tannic acid powder commercially available from Clariant Corporation (Charlotte, N.C.) under the trade designation CLM Powder. Desirably, the aqueous treating compositions of the present invention contain at least one tannic acid, wherein the tannic acid is ASP powder.

The amount of tannic acid in the aqueous treating compositions of the present invention is set to produce a desired level of tannic acid on a fiber, carpet yarn, or carpet. Desirably, the tannic acid is present in the aqueous treating composition in an amount of up to about 0.5 parts by weight (pbw), based on a total weight of the aqueous treating composition. More desirably, the tannic acid is present in an amount ranging from about 0.005 pbw to about 0.4 pbw tannic acid, based on a total weight of the aqueous treating composition.

C. Crosslinking Agent

The aqueous treating compositions of the present invention may further comprise at least one crosslinking agent. Suitable crosslinking agents include, but are not limited to, antimony potassium tartrate (APT), stannous chloride, and a combination thereof. Antimony potassium tartrate (APT) has been found to be particularly useful as a crosslinking agent during a wet fixation application. As used herein, the term "wet fixation application" refers to a method of (i) applying an aqueous treating composition to fibers, yarns or carpet, and (ii) fixing one or more components of the aqueous treating composition onto the fibers, yarns or carpet by subjecting the fibers, yarns or carpet to steam or a steam-containing environment. Further, as used herein, the term "wet fixation step" refers to a step of fixing one or more components of an aqueous treating composition onto fibers, yarns or carpet by subjecting the fibers, yarns or carpet to steam or a steam-containing environment.

Stannous chloride has been found to be particularly useful as a crosslinking agent during a dry fixation application. As used herein, the term "dry fixation application" refers to a method of (i) applying an aqueous treating composition to fibers, yarns or carpet, and (ii) fixing one or more components of the aqueous treating composition onto the fibers, yarns or carpet by subjecting the fibers, yarns or carpet to dry heat, such as in an oven (i.e., without subjecting the fibers, yarns or carpet to steam or a steam-containing environment as in the wet fixation application. Further, as used herein, the term "dry fixation step" refers to a step of fixing one or more components of an aqueous treating composition onto fibers, yarns or carpet by subjecting the fibers, yarns or carpet to dry heat, such as in an oven (i.e., without subjecting the fibers, yarns or carpet to steam or a steam-containing environment as in a wet fixation step).

Several commercially available crosslinking agents are suitable for use in the present invention. Suitable commercially available crosslinking agents include, but are not limited to, antimony potassium tartrate commercially available from Lenmar Corporation (Dalton, Ga.), and stannous chloride produced by Yorkshire Americas (Dalton, Ga.), and sold as INTRATEX® SCS. Desirably, the aqueous treating composition of the present invention contains at least one crosslinking material, wherein the preferred crosslinking material is APT for wet fixation applications, and stannous chloride for dry fixation applications.

The amount of crosslinking material in the aqueous treating compositions of the present invention may vary depending on a number of factors including, but not limited to, the type of application (i.e., wet or dry fixation application), the other components used in the aqueous treating composition, and the type of fiber and/or carpet yarn treated. Desirably, the crosslinking material is present in the aqueous treating composition in an amount of up to about 5.0 pbw crosslinking material, based on a total weight of a given aqueous treating composition. More desirably, the crosslinking material is present in an amount ranging from about 0.001 pbw to about 5.0 pbw crosslinking material, based on a total weight of a given aqueous treating composition.

D. Other Optional Components

The aqueous treating compositions of the present invention may also include one or more of the following optional components.

1. Fluorochemical Compounds

The aqueous treating compositions of the present invention may optionally contain at least one fluorochemical compound. The fluorochemical compound may be an anionic or nonionic fluorochemical. Further, the fluorochemical compound may be either a telomer type or an electrochemically fluorinated fluorochemical. Several commercially available fluorochemical compounds are suitable for use in the present invention. Suitable fluorochemical compounds include, but are not limited to, DAIKIN TG 571, TG 472, TG 3530, TG 3360 and TG 3311, all of which are commercially available from Daikin America, Inc. (Orangeburg, N.Y.); PM 1396 and PM 1451, both of which are commercially available from 3M Specialty Chemicals Division (St. Paul, Minn.); N140 and N 141, both of which are commercially available from DuPont Flooring Systems (Wilmington, Del.); TG-232D, which is commercially available from Advanced Polymers, Inc. (Salem, N.H.); and Nuva CPA, which is commercially available from Clariant Corporation (Charlotte, N.C.).

When present, the aqueous treating compositions of the present invention desirably contain at least one fluorochemical compound, wherein the fluorochemical compound is DAIKIN TG 3530 or TG 3360. The DAIKIN fluorochemical products are believed to be polymers having a vinyl chloride functionality incorporated into the polymer backbone. The DAIKIN TG 3530 and TG 3360 are examples of DAIKIN fluorochemicals that are believed to incorporate vinyl chloride in the polymer backbone.

The amount of fluorochemical compound in the aqueous treating compositions of the present invention may vary depending on a number of factors including, but not limited to, the treated fiber or yarn, the process steps used to treat the fiber or yarn, the type of application (i.e., wet or dry fixation application), and the level of fluorochemical desired on the fiber or yarn. The fluorochemical compound may be present in the aqueous treating composition in an amount ranging from 0.0 pbw to about 10 pbw, based on a total weight of the aqueous treating composition. When present, the fluorochemical compound is desirably present in an amount ranging from about 0.001 pbw to about 5.0 pbw solids, based on a total weight of the aqueous treating composition.

The fluorochemical compounds suitable for use in the present invention may be generally described as any fluorochemical compound that produces a stable solution or dispersion when incorporated into the application baths described herein. The most desirable fluorochemical compounds for use in the present invention are anionic fluorochemical compounds, since these compounds are more stable in solutions having an acidic pH and containing other chemicals described herein. Non-ionic fluorochemical compounds may also be useful in the present invention. Further, cationic fluorochemical compounds may also be useful in the present invention.

2. Organosilicate Compounds

The aqueous treating compositions of the present invention may also optionally contain at least one organosilicate compound. Suitable organosilicate compounds for use in the present invention include, but are not limited to, organosilicate compounds disclosed in U.S. Pat. Nos. 4,351,736 and 4,781,844, both of which are assigned to Bayer Aktiengesellschaft (Leverkusen, Germany), and both of which are incorporated herein by reference in their entirety. As disclosed in U.S. Pat. No. 4,351,736 (hereinafter, "the '736 patent") and U.S. Pat. No. 4,781,844 (hereinafter, "the '844 patent"), the organosilicates are formed from one or more silanes selected from (i) silanes having the general formula $R—Si(OR')_3$ and (ii) silanes having the general formula $Si(OR')_4$ wherein R represents a substituted or unsubstituted hydrocarbon radical having from 1 to 7 carbon atoms and substituents selected from halogens, amino groups, mercapto groups, and epoxy groups, and R' represents an alkyl radical having from 1 to 4 carbon atoms.

The organosilicate compounds are formed by mixing the silanes with water, a buffer substance, a surface-active agent, and when appropriate, an organic solvent, and agitating the mixture under acidic or basic conditions. Desirably, the resulting polymers are formed from about 2 to about 50 percent by weight, more desirably, about 3 to about 20 percent by weight, of silanes having the general formula $Si(OR')_4$ based on a total weight of silanes used to form the polymers. Desired silanes for forming the organosilicate compounds include, but are not limited to, methyltrimethoxysilane, methyltriethoxysilane, methyltriisopropoxysilane, ethyltrimethoxysilane, ethyltriethoxysilane, propyltrimethoxysilane, isobutyltrimethoxysilane, isobutyltriethoxysilane, 2-ethylbutyltriethoxysilane, tetraethoxysilane, 2-ethylbutoxytriethoxysilane, and combinations thereof. Desirably, the surface-active agent comprises a cationic compound containing a halide, more desirably, a chloride or bromide-containing compound.

Several commercially available organosilicate compounds are suitable for use in the present invention. Suitable organosilicate materials include, but are not limited to, BAYGARD® AS and BAYGARD® SNF, both of which are commercially available from Bayer Specialty Chemicals (Wellford, S.C.). Desirably, the aqueous treating compositions of the present invention contain at least one organosilicate compound, wherein the organosilicate compound is BAYGARD® SNF.

The amount of organosilicate compound in the aqueous treating compositions of the present invention may vary depending on a number of factors including, but not limited to, the treated fiber or yarn, the process steps used to treat the fiber or yarn, and the level of fluorochemical desired on the fiber or yarn. The organosilicate compound may be present in the aqueous treating composition in an amount ranging from 0.0 pbw to about 5.0 pbw based on a total weight of the aqueous treating composition. When present, the organosilicate compound is desirably present in an amount ranging from about 0.005 pbw to about 5.0 pbw solids, based on a total weight of the aqueous treating composition.

3. Anionic Polymer-Binding Compounds and Other Stain-Resist Compounds

The aqueous treating compositions may also include an optional anionic polymer-binding compound and/or a stain-resist compound. The anionic polymer-binding compound may serve as a stain-resist compound, although this function is not required. For example, when the carpet yarn is made from polypropylene, there are no acid dye sites for the anionic polymer-binding compound to block. Nevertheless, it has been discovered that the use of an anionic polymer-binding compound improves the performance of a fluorochemical compound on polypropylene carpet yarn, as well as other yarns, when present. While not wishing to be bound by any particular theory, it is believed that the anionic polymer-binding compound functions to hold the fluorochemical onto the surface of the fiber.

Several anionic polymer-binding compounds also function as stain-resist compounds on nylon carpet yarn and have been found to work well in the present invention. Exemplary anionic polymer-binding compounds are polymers or copolymers of methacrylic acid. Desirably, these polymers or copolymers have a molecular weight range such that the lower 90 weight percent has a weight average molecular weight in the range of about 2500 to 250,000 and a number average molecular weight in the range of 500 to 20,000. One particularly desirable anionic polymer-binding compound is a polymethacrylic acid commercially available from Rohm & Haas under the designation LEUKOTAN® 1028. The molecular weight of the lower 90 weight percent based on weight, average for LEUKOTAN® 1028 is reported to be 9,460 and based on number average is reported to be 5,592.

Another particularly desirable anionic polymer-binding compound is a polymer of methacrylic acid designated XP-4-49, which is made by the following procedure. Into a reaction vessel, equipped with a reflux condenser, heating, agitation, thermometer, and an inert gas blanket, is added 54 lbs of methacrylic acid, 452 lbs of water, and 1.0 lbs of NaOH. This mixture is referred to as aqueous phase A. Monomer feed B is prepared by mixing 214 lbs of methacrylic acid, 303 lbs of water, 0.16 lbs of diallyl maleate and 2.2 lbs of NaOH. Two catalyst feeds C and D are also prepared. Feed C consists of 2.2 lbs potassium persulfate and 197 lbs of water. Feed D consists of 2.2 lbs of sodium metabisulfite and 197 lbs of water.

Mixture A is heated to a temperature of about 85° C. to about 90° C. under a nitrogen blanket for 30 minutes. 1.3 lbs of potassium persulfate and 1.3 lbs. of sodium metabisulfite are added to initiate the reaction, resulting in a small exotherm of about 3° C. to about 5° C. Feeds B, C and D are then added to the reaction vessel over a period of about one hour with the temperature of the vessel maintained at about 90° C. to about 95° C. At the end of the addition period, the batch is held at a temperature of about 90° C. to about 95° C. for one hour. During this hour, 0.35 lbs of potassium persulfate, 0.35 lbs of sodium metabisulfite and 2.2 lbs NaOH are added every 15 minutes for a total of 3 additions.

The resulting product, referred to as XP-4-49, is a slightly hazy, viscous liquid with 20.4% solids, a pH of 3.7 and a viscosity of 4800 cps measured on a Brookfield Viscometer with a #2 spindle at room temperature.

Desirably, the XP-4-49 is mixed with a lesser amount of a phenolic type stain-resist compound sold by Sybron Chemicals, Inc. (Birmingham, N.J.), now a division of Bayer Chemicals (Baytown, Tex.), under the trade designation "Tanatex Stainfree." The desired ratio of XP-4-49 to Tanatex is about 18:1 based on solids. In one exemplary embodiment, 73.1 parts of XP-4-49, including the water in which it is made, is added to 24.5 parts water and 2.4 parts Tanatex Stainfree. The resulting mixture is a clear, viscous, amber liquid with a final viscosity of about 68 cps. This particular mixture is designated XP-4-50 and is a desirable anionic polymer-binding/stain-resist compound for use in the method of the present invention.

Other anionic polymer-binding/stain-resist compounds have also been shown to work well. The following compositions from 3M Specialty Chemicals Division (St. Paul, Minn.) have worked well: FX-369, FX-668F, FX-661, and FX-657. The principal ingredient of FX-369 is believed to be a phenolic resin. All of the other 3M stain-resist compositions are believed to comprise a methacrylic acid polymer or copolymer and are believed to be described in at least one of U.S. Pat. Nos. 4,937,123 and 4,822,373, both of which are assigned to the 3M. Company (St. Paul, Minn.).

Another suitable anionic polymer-binding/stain-resist compound for use in the present invention is a product sold by DuPont Flooring Systems (Wilmington, Del.) under the trade designation "SR 500." SR 500 is a proprietary composition with a styrene-maleic anhydride co-polymer as the principal ingredient.

In addition to LEUKOTAN® 1028 referred to above, other LEUKOTAN® compounds from Rohm & Haas are useful in the present invention, in particular, LEUKOTAN® 1027, 970 and 1084. With the exception of the LEUKOTAN® 1084, the LEUKOTAN® compositions are all polymers and copolymers of methacrylic acid of varying molecular weights. Although these compounds are generally sold to the tanning industry, U.S. Pat. No. 4,937,123 (assigned to the 3M Company, St. Paul, Minn.) refers to this group as having stain-resist properties when applied to nylon carpet fibers. LEUKOTAN® 1084 is believed to be a polymer of acrylic acid.

Other suitable stain-resist materials are commercially available from Peach State Labs, Inc. (Rome, Ga.). One product, known as RM, has also shown to be useful in the described invention. The RM product is thought to be a modified phenolic material. Other stain-resist materials available from Peach State Labs include AP63, a multipolymer stain and soil resist agent described in U.S. Pat. No. 6,524,492 and assigned to Peach State Labs, Inc., the disclosure of which is incorporated herein in its entirety by reference; M50C, a 5% fluorine/soil resistant polymer mixture; and M50D, a 5% fluorine/soil resistant polymer mixture. Still other suitable stain-resist materials are commercially available from Simco Corporation (Greer, S.C.), such as DGF 30, an acid stain-resist polymer emulsion.

Desirably, the stain-resist material used in the present invention is AP63. It is believed that AP63 comprises, in part, an aqueous emulsion of polymerized monomers, wherein the monomers comprise (meth)acrylic acid, alkyl(meth)acrylic acid, and a substituted or unsubstituted styrene as disclosed in U.S. Pat. No. 6,524,492. In one exemplary embodiment of the present invention, AP63 is combined with a tannic acid and, optionally, APT and/or a fluorochemical component, and applied to a fiber, yarn or carpet using a wet fixation application as described above.

When present, each of the anionic polymer-binding compounds and/or stain-resist compounds are desirably present in the aqueous treating composition in an amount ranging from greater than 0.0 pbw to about 2.0 pbw solids, based on a total weight of the aqueous treating composition. The anionic polymer-binding compound and/or stain-resist compound, when present, are each independently more desirably present in an amount ranging from about 0.001 pbw to about 1.0 pbw solids, based on a total weight of the aqueous treating composition.

4. Colorants

In some cases, the aqueous treating compositions may also include one or more colorants including dyes and pigments. For example, when the carpet yarn or carpet comprises nylon or polyester fibers, a dye may be added to the aqueous treating composition. Suitable dyes include, but are not limited to, acid dyes, cationic dyes, disperse dyes, metal-complex dyes, and combinations thereof. Suitable commercially available dyes include, but are not limited to, OTC 200, a Tectilon Orange TC 200 powder acid dyestuff available from Ciba Corporation (Greensboro N.C.); R2BM 200, a Telon Red 2BM 200 powder acid dyestuff available from Dystar Corporation (Charlotte N.C.); and BRM 200, a Telon Blue BRL 200 powder acid dyestuff available from Dystar Corporation.

5. pH Adjuster

The aqueous treating compositions of the present invention may also include a pH adjuster, such as an acid or base material. Suitable pH adjusters include, but are not limited to, phosphoric acid, such as phosphoric acid 75% commercially available from Vulcan Chemicals (Dalton, Ga.); and urea sulfate commercially available from Peach State Labs, Inc. under the trade designation A-80N Acid.

In one exemplary embodiment of the present invention, the aqueous treating composition has a pH of less than about 3.0. Desirably, the aqueous treating compositions of the present invention have a pH of less than about 2.5, more desirably, from about 2.0 to about 2.5 for long bath exhaust processes (i.e., liquor to greige ratios in the range of about 60:1 to about 10:1), and from about 1.5 to about 2.2 for continuous exhaust processes (i.e., liquor to greige ratios less than about 10:1).

6. Other Optional Components

When used in combination with one or more dyes or pigments, the aqueous treating compositions may also contain one or more additives including, but not limited to, a chlorine scavenger, such as sodium thiosulfate (STS); a hard water scavenger, such as sodium hexametaphosphate (SHMP); a surfactant, such as DOWFAX® 2A1 surfactant; and an acid buffer, such as ammonium sulfate. Further, other optional components may be added to any treatment step (i.e., prior to, during, or after a dyeing step).

III. Method of Making the Treating Composition

The aqueous treating compositions of the present invention may be prepared using the following exemplary procedure. Water is added to a mixing vessel. Tannic acid, when present, is then added to the water, followed by the one or more crosslinking materials. Ambient water having a water temperature in the range of 21.1° C. (70° F.) to 32.3° C. (90° F.) may be used to prepare the treatment mixture, although water having a temperature greater than or less than the above range may also be used. In this method of making the treating composition of the present invention, the treating composition comprises water, an optional tannic acid, and at least one crosslinking component.

As described above, the aqueous treating compositions may also comprise one or more optional components in addition to the water, tannic acid and crosslinking material. In these embodiments, the aqueous treating compositions may be prepared by the following exemplary procedure. Typically, the fluorochemical, organosilicate polymer and stain-resist compounds are provided by the manufacturer in a concentrated aqueous dispersion. These concentrates can be simply added to water, tannic acid and crosslinking material in a mixing vessel and stirred at room temperature. Because some of the fluorochemical and/or stain-resist compositions are in emulsion form, which may be sensitive to high shear, stirring is desirably done at low shear.

In one exemplary embodiment of the present invention, the aqueous treating composition is prepared by first adding a desired amount of water to a vessel. The anionic binding compound, when present, is then added, followed by the organosilicate compound, when present, then the fluorochemical compound, when present, then the tannic acid and the one or more crosslinking materials, and lastly, the acid for pH adjustment if desired. The aqueous treating compositions may be prepared as a batch, in a holding tank, for delivery to the application equipment, or, alternatively, may be prepared in a continuous mixing fashion, for direct application, with no need for a holding vessel, by using pumps, flow meters and static or dynamic mixing equipment.

IV. Method of Treating Fibers, Carpet Yarns and Carpets

The present invention is further directed to methods of treating fibers, carpet yarns and carpets by contacting the fibers, carpet yarns and/or carpets with at least one of the above described aqueous treating compositions. In one desired embodiment of the present invention, carpet yarn is immersed in the aqueous treating composition. Desirably, this is accomplished by immersing carpet in a bath of the aqueous treating composition. More desirably, the carpet is immersed by drawing the carpet through a puddle of the aqueous treating composition in an apparatus such as an apparatus known in the industry as a "flex nip applicator." Alternatively, the carpet may be placed in a vessel containing the aqueous treating composition, such as a dyeing vessel. Still further, the aqueous treating composition may be sprayed or cascaded onto the carpet so as to immerse the carpet.

The aqueous treating compositions may be applied to a fiber, carpet yarn or carpet using any conventional coating method including, but not limited to, a slot coating step, a dip coating step, a spray coating step, a pad coating step, and combinations thereof. In one desired embodiment of the present invention, the aqueous treating composition is applied to a fiber, carpet yarn or carpet using a wet fixation application containing a slot-coating step. In a further desired embodiment of the present invention, the aqueous treating composition is applied to a fiber, carpet yarn or carpet using a dry fixation application containing a spray-coating step or a foam coating step.

The amount of aqueous treating composition applied to the carpet or carpet yarn may vary depending on a number of factors including, but not limited to, the type of application (i.e., wet or dry fixation application), and the processing equipment used for a given application. For example, the amount of aqueous treating composition applied to the carpet or carpet yarn during a wet fixation application is desirably an amount so as to provide a ratio of carpet (or carpet yarn) to aqueous treating composition of at least about 0.5 to 1. A common expression for the amount of liquid applied to carpet is "wet pick-up." Using this expression, the desired wet pick-up is at least about 50 percent (i.e., at least about 50 grams of aqueous treating composition is "picked-up" by 100 grams of carpet or carpet yarn). More desirably, the wet pick-up is between about 50 percent and about 6000 percent (i.e. a ratio of about 0.5:1 to about 60:1). Even more desirably, the wet pick-up is between about 100 and about 500% (i.e. a ratio of about 1:1 to about 5:1). In contrast, the amount of aqueous treating composition applied to the carpet or carpet yarn during a dry fixation application is desirably less than about 100%, more desirably, less than about 40%, and even more desirably, from about 10 to about 15%. Control of the wet pick-up level may be accomplished by conventional means, such as squeeze rollers and the like.

Heating the aqueous treating composition in contact with the fiber or carpet yarn has been found to enhance the performance of the method of the present invention. As shown in the examples below, a heating step greatly shortens the time needed to get good exhaustion of tannic acid and/or crosslinking material (or any other component) onto the fiber or yarn (i.e., fix one or more components onto the fiber or yarn). Thus, although not required, a heating step greatly improves the efficiency of the method. While not wishing to be bound by any particular theory, it is believed that the heat treatment helps cure or fix the molecules of tannic acid and/or crosslinking material to the fibers or carpet yarns.

In one embodiment of the present invention, a heating step is performed at a temperature ranging from about 71° C. (160° F.) to about 127° C. (260° F.) for a period of time ranging from about 15 second to about 60 minutes, more desirably, at a temperature from about 82° C. (180° F.) to about 104° C. (220° F.) for a period of time ranging from about 30 second to about 8 minutes. Even more desirably, the heating step is accomplished by exposing the carpet treated with the aqueous treating composition to steam at ambient pressure, i.e. 100° C. (212° F.) for up to about 90 seconds (i.e., a wet fixation application).

After the heating step, the carpet is desirably rinsed to remove excess chemicals. The rinsing step may be done by any conventional means. Typically, warm water having a water temperature of about 60° C. (140° F.) is used to rinse the treated carpet or carpet yarns. After rinsing, excess water is desirably removed by conventional means, such as a vacuum extractor. Typically, the water content after extracting is from about 20 to about 30 parts by weight based on a total weight of the carpet. After excess water is removed from the carpet, the carpet is typically dried in a flow-through oven. Desirably, the carpet is dried at a drying temperature of no greater than 121.1° C. (250° F.) for a drying period of about 2 to about 3 minutes. Once dried, the treated fiber, yarn or carpet may be subjected to one or more additional aqueous treating compositions of the present invention, such as a topical treatment described below.

In one exemplary embodiment of the present invention, the aqueous treating composition is applied to fibers, carpet yarns or carpet before, during, or after a dyeing step. In this embodiment, the method of treating a fiber, carpet yarn or carpet comprises applying an aqueous treating composition onto the fiber, carpet yarn or carpet, and allowing the aqueous treating composition to remain in contact with the fiber, carpet yarn or carpet for a desired period of time. Typically, the aqueous treating composition remains in contact with the fiber, carpet yarn or carpet for a period of up to about 180 seconds, when a continuous application mode is used. The above method of treating a fiber, carpet yarn or carpet may further comprise one or more of the following steps: (1) applying one or more colorants to the fiber, carpet yarn or carpet; (2) applying wet heat (i.e., steam) or dry heat (i.e., hot air) to the treated fiber, carpet yarn or carpet; (3) rinsing the treated fiber, carpet yarn or carpet with an aqueous solution; (4) applying one or more secondary aqueous treatment compositions onto the fiber, carpet yarn or carpet; and (5) drying the treated fiber, carpet yarn or carpet using dry heat (i.e., no steam).

A variety of heating steps may be used to expose the treated fiber, carpet yarn or carpet to a desired amount of heat. In one desired embodiment of the present invention, steam having a temperature of about 100° C. (212° F.) is brought into contact with the treated fiber, carpet yarn or carpet for a period of up to about 5 minutes, desirably, from about 45 seconds to about 3 minutes. Although steam treatment is a desired heating method, other heating methods may be used including, but not limited to, exposing the treated fiber, carpet yarn or carpet to hot air, such as in a flow-through oven.

As discussed above, the treated fiber, carpet yarn or carpet may be rinsed using warm water having a desirable water temperature of about 60° C. (140° F.). During the rinse step, other treatment components may be applied to the treated fiber, carpet yarn or carpet. For example, an aqueous treating composition containing tannic acid and a crosslinking material may be slot-coated onto a fiber, carpet yarn or carpet in a first step, exposed to a steam heating step, and subsequently exposed to a wash or rinse step, wherein additional treating components are within the warm water used during the rinse or wash step. For example, a fluorochemical compound as described above could be applied during the rinse or wash step. As discussed above, following a rinse or wash step, excess water may be removed from the treated fiber, carpet yarn or carpet. The fiber, carpet yarn or carpet may then be dried in an apparatus, such as a flow-through oven.

In other exemplary embodiments of the present invention, the aqueous treating composition may be applied to a fiber, carpet yarn or carpet during a dyeing process. In this embodiment, the aqueous treating composition further contains a dye, such as the dyes described above.

It should be noted that the method of treating a fiber, carpet yarn or carpet embodied by the present invention may comprise one or more of the above-mentioned steps. For example, multiple dyeing steps, aftertreatment steps, topical treatment steps, heating steps, and/or wash/rinse steps may be used to prepare a dyed, treated fiber, carpet yarn or carpet of the present invention.

In one desired embodiment of the present invention, the method of treating fibers, carpet yarns or carpets comprises (i) applying a first aqueous treating composition onto the fibers, carpet yarns or carpets wherein the first aqueous treating composition contains at least one tannic acid, at least one crosslinking agent and at least one stain-resist material, and (ii) applying a second aqueous treating composition onto the fibers, carpet yarns or carpets, wherein the second aqueous treating composition contains at least one crosslinking agent and, optionally, at least one fluorochemical compound. Desirably, the first aqueous treating composition contains at least one tannic acid, APT, and AP63, and the second aqueous treating composition comprises stannous chloride and DAIKIN TG 3360. Further, the first aqueous treating composition is desirably applied using a wet fixation application (i.e., one involving steam) such as an exhaust aftertreatment step having a processing temperature of about 76.7° C. (170° F.) and a hold time of from about 20 to about 30 minutes, or a continuous after treatment step having a steam fixation step for about 45 seconds, while the second aqueous treating composition is desirably applied using a dry fixation application wherein the fibers, carpet yarns or carpets are brought into contact with a spray or foam, and are subsequently dried with dry heat (e.g., hot air). When a foam application is utilized, a foaming agent may also be present in the aqueous treating composition.

In a further desired embodiment of the present invention, the method of treating fibers, carpet yarns or carpets comprises applying an aqueous treating composition onto the fibers, carpet yarns or carpets, wherein the first aqueous treating composition contains stannous chloride alone or in combination with a fluorochemical compound. This method may be used to further protect previously treated fibers, carpet yarns or carpets including, but not limited to, (i) color-free or color-containing fibers, carpet yarns or carpets previously treated with a tannic acid-containing composition, (ii) color-free or color-containing fibers, carpet yarns or carpets previously treated with any other composition, or (iii) a combination thereof.

V. Treated Fibers, Carpet Yarns and Carpets

The present invention is further directed to treated fibers, carpet yarns and carpets having a desired level of crosslinking material and, optionally, tannic acid on the fiber, carpet yarn or carpet. Desirably, the treated fiber or carpet yarn contains tannic acid in an amount of up to about 5.0 owf, based on a total weight of the dried fiber or carpet yarn. More desirably, the treated fiber or carpet yarn contains tannic acid in an amount ranging from about 0.05 owf to about 4.0 owf, based on a total weight of the dried fiber or carpet yarn.

The treated fiber or carpet yarn may also comprise one or more crosslinking materials. Desirably, the treated fiber or carpet yarn also contains one or more crosslinking materials in an amount of up to about 4.0 owf for each crosslinking material, based on a total weight of the dried fiber or carpet yarn. More desirably, the treated fiber or carpet yarn contains one or more crosslinking materials in an amount ranging from about 0.15 owf to about 0.75 owf for each crosslinking material, based on a total weight of the dried fiber or carpet yarn.

The treated fiber or carpet yarn may optionally comprise one or more optional components as described above. For example, in one exemplary embodiment of the present invention, the treated fiber or carpet yarn comprises one or more fluorochemical compounds, as described above, in an amount up to about 1,000 ppm owf, based on a total weight of the dried fiber or carpet yarn. More desirably, when present, the one or more fluorochemical compounds are present in an amount ranging from about 100 to about 800 ppm owf, based on a total weight of the dried fiber or carpet yarn.

The treated fiber or carpet yarn may also optionally comprise one or more stain-resist compounds such as the above-described organosilicate compounds, the anionic polymer binding compounds, the terpolymers (i.e., AP63), or a combination thereof. When present, the stain-resist compound is desirably present in an amount of up to about 4.0 owf, based on a total weight of the dried fiber or carpet yarn. More desirably, when present, the stain-resist compound is present in an amount ranging from about 0.25 to about 3.0 owf, based on a total weight of the dried fiber or carpet yarn.

In one exemplary embodiment of the present invention, the treated fibers or, carpet yarns are treated with one or more aqueous treating compositions (i.e., an aftertreatment composition, a topical spray or foam composition, or both), wherein the one or more aqueous treating compositions provide the treated fibers or carpet yarns with a desired amount of tannic acid; at least one crosslinking agent, desirably, antimony potassium tartrate; a pH adjuster, desirably, urea sulfate; and at least one stain-resist compound, desirably, AP63. In this exemplary embodiment of the present invention, the one or more aqueous treating compositions (i.e., an aftertreatment composition, a topical spray composition, or both) may further comprise at least one fluorochemical compound, desirably DAIKIN TG 3530 or TG 3360, more desirably, DAIKIN TG 3360, and a second crosslinking agent. Desirably, the one or more aqueous treating compositions of this embodiment comprise at least one fluorochemical compound, desirably DAIKIN TG 3530 or TG 3360, more desirably, DAIKIN TG 3360; and a second crosslinking agent, desirably, stannous chloride.

In a further exemplary embodiment of the present invention, the treated fibers or carpet yarns are treated with one or more aqueous treating compositions (i.e., an aftertreatment composition, a topical spray or foam composition, or both), wherein the one or more aqueous treating compositions provide the treated fibers or carpet yarns with a desired amount of tannic acid; a pH adjuster, desirably, urea sulfate; at least one stain-resist compound, desirably AP63; and at least one fluorochemical compound, desirably DAIKIN TG 3530 or TG 3360, more desirably, DAIKIN TG 3360. In this exemplary embodiment of the present invention, the one or more aqueous treating compositions (i.e., an aftertreatment composition, a topical spray composition, or both) may further comprise at least one crosslinking agent, desirably, stannous chloride.

The treated fibers, carpet yarns and carpets of the present invention have a desired resistance to discoloration due to the presence of one or more chemical additives on the fiber, carpet yarn or carpet. One method of measuring the resistance to discoloration of a given fiber or carpet yarn is to measure a color value of a carpet sample containing the fiber or yarn prior to and after exposure of the carpet sample to a given composition. The change in color may be measured using an apparatus such as a Macbeth contact spectrophotometer (Model 20/20) available from Kollmorgen Corporation (Brooklyn, N.Y.).

The change in color may be measured for various staining compositions including, but not limited to, a Clorox staining composition, a red dye staining composition, a caustic staining composition, an ammonia staining composition, a mustard staining composition, or any combination thereof.

Desirably, the treated fibers, carpet yarns and carpets of the present invention have a combined discoloration factor of less, than about 35 ΔE units, wherein the combined discoloration factor is a sum of five separate ΔE values corresponding to the following individual staining tests: (i) a Clorox solution-staining composition, (ii) a red dye staining composition, (iii) a caustic solution staining composition, (iv) an ammonia solution staining composition, and (v) a mustard staining composition, each ΔE value being measured using a Macbeth contact spectrophotometer (Model 20/20). More desirably, the treated fibers, carpet yarns and carpets of the present invention have a combined discoloration factor of less than about 25 ΔE units, less than about 20 ΔE units, less than about 15 ΔE units, and even less than about 10 ΔE units.

VI. Methods of Cleaning Treated Fibers, Carpet Yarns and Carpets

The present invention is further directed to a method of cleaning treated fibers, carpet yarns and carpets. The treated fibers, carpet yarns and carpets of the present invention may be cleaned with a variety of cleaning compositions including, but not limited to, high pH cleaning solutions, such as dilute caustic solutions and ammonia-containing solutions. Prior to the present invention, high pH cleaning solutions negatively impacted the coloration of dyed fibers, carpet yarns and carpets, especially nylon fibers, yarns and carpets treated with tannic acid compositions. The high pH cleaning solutions typically either (i) resulted in partial removal of one or more dyes resulting in an alteration of the color shade, or (ii) reacted with one or more components on the surface of the treated fiber, carpet yarn or carpet resulting in a unpleasant stain, such as a brown stain, or yellow discoloration. These types of brown or yellow discolorations are more pronounced in lighter carpet colorations, such as off-white colors, and light tan or gray colors. The treated fibers and carpet yarns of the present invention may be cleaned using high pH cleaning solutions without negatively impacting the coloration of the treated fibers, carpet yarns and carpets.

In one exemplary embodiment of the present invention, the method of cleaning treated fibers, carpet yarns or carpets comprises applying a cleaning solution having a pH of greater than about 7.5 to the treated fibers, carpet yarns or carpets. The cleaning solution may be, for example, a caustic-containing solution, an ammonia-containing solution, or a bleach-containing solution. The cleaning solution may have a pH of greater than about 8.0 (or greater than about 8.5, greater than about 9.5, greater than about 10.0, or greater than about 10.5).

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

The following materials are used in the examples below:

Greige Materials

2099 Greige—Solutia T1993 contract staple fiber, Suessen set, tufted into a 30 oz per square yard construction.

1353 Eco Solution Q SK—Shaw extruded T6 nylon, Suessen set, tufted into a 28 oz per square yard level loop construction, skein dyed into a light beige shade using level dyeing acid dyes.

1354 Eco Solution Q SK—Shaw extruded T6 nylon, melt colored at extrusion using pigments into a light beige shade, Superba set, tufted into a 28 oz per square yard construction.

1360 Solutia Sk—Solutia 1360 T66 filament nylon, Superba set, skein dyed into a light beige shade, tufted into a 28 oz per yard level loop construction.

1202 Solutia SD—Solutia 1202 T66 filament nylon, melt colored at extrusion using pigments into a light beige shade, Superba set, tufted into a 28 oz per square yard level loop construction.

1250 BASF Savant—BASF bi-component extruded T6-12/T6 nylon, Superba set, skein dyed using level dyeing acid dyes into a light beige shade, tufted into a 28 oz per square yard level loop construction.

1245 DuPont Lumena—DuPont Lumena T66 nylon filament, melt colored at extrusion using pigments into an off white shade, Superba set, tufted into a 28 oz per square yard level loop construction.

Chemicals

STS—sodium thiosulfate, used as a chlorine scavenger to prevent chlorine interference during the dyeing step.

SHMP—sodium hexametaphosphate, used as a scavenger for water hardness to prevent interference during the dyeing step.

2A1—DOWFAX® 2A1 surfactant for assisting in leveling and transfer of acid dyes during the dyeing step.

Ammonium Sulfate—an acid buffer used to lower and control the bath pH during the dyeing step.

ASP—Tannic Acid ASP powder supplied by Aceto Corporation.

3SP—Tannic Acid 3SP powder supplied by Aceto Corporation.

BAYGARD® CL Liquid—Solution of Tannic Acid supplied by Bayer Corporation.

CLM Powder—Tannic Acid powder supplied by Clariant Corporation.

Gallic Acid—Gallic Acid 96% supplied by Aldrich Chemicals.

SCS—17% Stannous Chloride powder supplied by Yorkshire.

APT—Antimony Potassium Tartrate supplied by Lenmar Corporation.

A-80N Acid—Urea Sulfate supplied by Peach State Labs.

TG 3530—10% fluorine telomer fluoropolymer emulsion supplied by Daikin.

OTC 200—Tectilon Orange, TC 200 powder acid dyestuff supplied by Ciba Corporation.

R2BM 200—Telon Red 2BM 200 powder acid dyestuff supplied by Dystar Corporation.

BRM 200—Telon Blue BRL 200 powder acid dyestuff supplied by Dystar Corporation.

AP63—multipolymer stain and soil resist agent supplied by Peach State Labs.

M50C—5% fluorine/soil resistant polymer mixture supplied by Peach State Labs.

M50D—5% fluorine/soil resistant polymer mixture supplied by Peach State Labs.

TG 3360—12% fluorine telomer fluoropolymer emulsion supplied by Daikin.

FX 668F—acid stain resistant polymer emulsion supplied by 3M Corporation.

DGF 30—acid stain resist polymer emulsion supplied by Simco Corporation.

Eulysine S—Polyacrylic Acid from BASF Corporation.

Acetic Acid 80%—Acetic Acid concentrated liquid supplied by Vulcan Chemicals.

Isopropanol—Isopropyl Alcohol supplied by Vulcan Chemicals.

Alum—Aluminum sulfate powder supplied by Vulcan Chemicals.

Carpet Construction

Carpet samples of greige 2099 were used in Examples 2-10 below.

Dyebath Composition

A dyebath having the following composition was used in Examples 2-10 below:

Liquor to greige ratio: 25:1
STS—0.125% owf
SHMP—0.1% owf
2A1—1.0% owf
Ammonium Sulfate—1.5% owf
OTC 200—0.50 ml. of a 2 g/l solution
R2BM 200—0.40 ml. of a 2 g/l solution
BRM 200—0.90 ml. of a 2 g/l solution Methods Used in Examples Except for the variances noted below, the examples were all performed using one or more of the following method steps:

Ahiba Dyeings

Ahiba dyeing refers to the use of an Ahiba exhaust dyeing lab machine. 800 ml PYREX® tubes are filled with a dyebath composition. The greige carpet sample enters into a tube and is held in the bath via a stainless steel fork assembly. The dyebath comprises a 25:1 liquor ratio (i.e., dye liquor to sample weight ratio).

The fork assembly moves up and down, and also twists slightly to provide mechanical circulation during the dyeing cycle. The dye machine is heated via electric coils, which heat an oil bath, which in turn heats the contents of the 800 ml PYREX® tubes containing the dyebath and greige material.

The dye cycle starts at 21.1° C. (70° F.), heats from 21.1° C. (70° F.) to 90.6° C. (195° F.) at a heating rate of about 0.83° C. (1.5° F.) per minute, and remains at 90.6° C. (195° F.) for 60 minutes. The machine then begins a cooling process via indirect contact with tap water through cooling coils in the oil bath. The machine cools back to 21.1° C. (70° F.), and is ready for the next cycle.

The fork assembly and greige carpet sample are removed from the machine, and labeled as appropriate for record keeping. The 800 ml PYREX® tubes are removed from the machine and emptied to prepare for the next dyebath. The dyed greige carpet sample is then rinsed with water, and extracted using a centrifuge to remove the residual moisture down into a range of about 15% moisture on fiber.

Ahiba Aftertreatment

Ahiba aftertreatment refers to the use of the Ahiba exhaust dyeing lab machine described above for further treatment of the dyed greige samples. The dyed greige samples are subjected to a chemical treatment bath. The operation of the machine is the same as described above for the dyeing cycle, with the exception that the hold temperature is 76.7° C. (170° F.), and the hold time is 30 minutes.

Continuous Dyeing

Continuous dyeing refers to the use of a flat stainless steel pan, and LEXAN® plate for application of low liquor ratio dyebaths to greige material samples. The liquor ratio for these lab dyeings is in the range of about 4:1 liquor to greige sample weight. The dyebath is poured into the stainless steel pan, which is positioned on a flat surface. Then, the greige sample material to be, dyed enters into the pan, pile facing down, and pressed into the liquor using the LEXAN® plate to force the liquor up and into the pile for complete penetration of the dyebath throughout the greige sample.

The greige sample with the dyeing liquor applied is then placed into a horizontal lab steamer with the pile facing up. The sample is then exposed to a saturated steam environment for about 120seconds. The sample is then removed and turned so that the pile is facing down, and re-enters the saturated steam environment for an additional 120 seconds. The dyed greige sample is then removed from the steam environment, rinsed, and extracted using a centrifuge to remove residual moisture down into the range of about 15% moisture on weight of fiber.

Continuous Aftertreatment

Continuous aftertreatment refers to the application of a chemical treatment bath to the previously colored greige sample material using the continuous dyeing technique described above. The exception is that the steaming time is reduced from a total of 240 seconds to a total of 180 seconds.

Topical Spray

Topical spray refers to the addition of a chemical bath to the dyed and treated greige material, using a spray. A hand sprayer is used for this application. The application spray amount is 40 wt % of spray liquor based on a dry weight of the greige sample (i.e., for a 100 gram greige sample, 40 grams of spray liquor is applied to achieve a 40 wt % add-on).

After the greige sample material has been scoured, dyed, and exposed to an aftertreatment bath, the greige is rinsed and extracted via centrifuge, and then sprayed as required to achieve the desired add-on of treatment chemicals. Once sprayed, the greige sample is allowed to dry in a forced-air oven operating at 104.4° C. (220° F.) for about five minutes to remove moisture to a range of about 2% moisture or less based on the weight of the fiber.

Test Methods

The products of the examples were tested by one or more of the following test methods:

Tests for Determining the Potential for Staining or Discoloration of Carpet Greige Samples.

20% Clorox Test

A solution was made using 20% by weight of Clorox bleach in deionized water. 1 ml of the above solution was applied to the carpet sample and allowed to stand for 6 to 8 hours. The greige was then rinsed under tap water, extracted using a centrifuge, and allowed to condition at room temperature for four hours prior to visual grading and color measurement.

For visual grading, a visual gray scale rating system was used as described in ISO 105-A02. For color measurements, a Macbeth contact spectrophotometer (Model 20/20) was used to measure a control area of each sample that had no stain or chemical treatment solution applied. The exposed area was measured as the sample, and the color difference values reported (in ΔE values).

AR 40 Red Dye Test

A solution of 0.08 g/l FD&C Red 40 acid dye was made in deionized water, and the pH of the solution adjusted to 3 with citric acid. The solution was applied to the carpet sample and the results measured using the same procedures as described above.

Ammonia Test

A 0.20% solution of ammonia in water was used for this test. The solution was applied and the results measured using the same procedures as described above.

Caustic 10% Test

A solution of 10% by weight sodium hydroxide pellets was prepared in deionized water. The solution was applied and the results measured using the same procedures as described above.

Mustard Test

A mixture was made using 50% by weight French's® mustard in deionized water. The solution was applied and the results measured using the same procedures as described above.

Analytical Testing—Tannic Acid Samples

Molecular weights and gallic acid content were determined for samples using a Waters HPLC with RI detector. Tannic Acid standards spanning 634 $M_p$ to 1700 $M_p$ were used along with polystyrene standards spanning 1220 $M_p$ to 5630 $M_p$. Tetrahydrofuran was used as the eluent. Three injections were made and averaged to obtain the results below:

| Product | $M_n$ | $M_w$ | $M_z$ | $M_p$ | % Gallic | % solids |
|---|---|---|---|---|---|---|
| ASP | 1639 | 1802 | 1937 | 1956 | 0.96 | 98.5 |
| 3SP | 1784 | 2018 | 2200 | 2151 | 2.87 | 96.5 |
| CLM | 2045 | 2474 | 2742 | 2862 | 5.26 | 97.1 |
| BAYGARD ® CL Liquid | 1875 | 2228 | 2485 | 2844 | 12.05 | 33.2 |

Pump—Waters 590
Injector—Waters 717+WISP
Flow rate—0.85 ml/min
Injection volume—100 μl
Columns—
Waters styragel HR1 7.8 mm×300 mm
Waters styragel HR2 7.8 mm×300 mm
Waters styragel HR3 7.8 mm×300 mm
Column Heater—Waters 410 Regulated
Temperature—35° C.
Detector—Waters 410 dRI@ 16×
Sample Preparation Samples were prepared as 10% solids powder in distilled water. The above solutions were dried down to constant weight under vacuum. 4 mg of the residue was dissolved in 1 ml of THF, plus 25 μl TFAA. Shaken 15 hours. Diluted to 4 ml prior to analysis. Sample concentration was less than or equal to about 0.10%. Result and plot three injections per sample.

Example 1

Application of Tannic Acid-Containing Treatment Compositions onto a Variety of Previously Colored Contract Fabrics The following carpet sample substrates were used in the present example:

Sample A—Shaw 1353 Eco Solution Q Sk; Skein dyed; Suessen set

Sample B—Shaw 1354 Eco Solution Q Sk; Melt colored; Superba set

Sample C—Solutia 1360 Sk; Skein dyed; Superba set

Sample D—Solutia 1202 SD; Melt colored; Superba set

Sample E—BASF 1250 Savant; Skein dyed; Superba set

Sample F—DuPont 1245 Lumena; Melt colored; Superba set

The above samples are contract greige products, tufted into level loop constructions. Greige samples A, C and E are skein dyed with level dyeing acid dyes. Greige samples B, D and F are melt colored using pigments during fiber extrusion.

Each sample was scoured with deionized water to provide a wet pick-up of about 400 wt % water, and then extracted using a centrifuge. An aftertreatment and a topical spray were applied to most of the samples as shown in Table 1 below. Control samples did not receive an aftertreatment or a topical spray. The total wet pick-up during the aftertreatment step was about 400 wt % for each sample. The total steam time for each sample was 180 seconds. The total wet pick-up during the topical spray step was about 40 wt % for each sample.

Following the treatment steps, each sample was tested for discoloration using the above-described test procedures. The results are shown in Table 2 below. The color change data shown in Table 2 below contains color change data measured using (i) a visual gray scale rating as described in ISO 105-A02, and (ii) color difference values (ΔE) as measured using a Macbeth 20/20 contact spectrophotometer.

The visual gray scale rating system described in ISO 105-A02 assigns a value of from 1 to 5, wherein a value of 1 indicates a maximum amount of discoloration compared to the color prior to exposure to one or more staining compositions, while a value of 5 indicates essentially no discoloration compared to the color prior to exposure to one or more staining compositions.

The color difference as measured using a Macbeth 20/20 contact spectrophotometer is given in ΔE values. A large ΔE value indicates a large degree of discoloration due to exposure to one or more staining compositions, while a small ΔE value indicates a small degree of discoloration due to exposure to one or more staining compositions.

TABLE 1

Aftertreatment and Topical Spray Treatments

| | Aftertreatment Composition Components and Percent On Weight of Fiber | | | | | | | | | | | | | | Topical Spray Composition Components and Percent On Weight of Fiber | | | |
|---|---|---|---|---|---|---|---|---|---|---|---|---|---|---|---|---|---|---|
| Sample | Aftertreat | C1 | % owf | C2 | % owf | C3 | % owf | C4 | % owf | C5 | % owf | C6 | % owf | pH | C1 | % owf | C2 | % owf |
| 1-A | Control | | | | | | | | | | | | | | | | | |
| 1-A3 | Continuous | ASP | 0.2 | AP63 | 3.5 | APT | 0.15 | A80N | as req | | | | | 1.55 | TG 3530 | 0.5 | SCS | 0.5 |
| 1-A5 | Continuous | | | AP63 | 1 | APT | 0.15 | A80N | as req | | | M50D | 1.0 | 1.55 | none | | none | |
| 1-B | Control | | | | | | | | | | | | none | | none | | | |
| 1-B3 | Continuous | ASP | 0.2 | AP63 | 3.5 | APT | 0.15 | A80N | as req | | | | | 1.55 | TG 3530 | 0.5 | SCS | 0.5 |

TABLE 1-continued

| Aftertreatment and Topical Spray Treatments | | | | | | | | | | | | | | | | | |
|---|---|---|---|---|---|---|---|---|---|---|---|---|---|---|---|---|---|
| | Aftertreatment Composition Components and Percent On Weight of Fiber | | | | | | | | | | | | | Topical Spray Composition Components and Percent On Weight of Fiber | | | |
| Sample | Aftertreat | C1 | % owf | C2 | % owf | C3 | % owf | C4 | % owf | C5 | % owf | C6 | % owf | pH | C1 | % owf | C2 | % owf |
| 1-B5 | Continuous | | | AP63 | 1 | APT | 0.15 | A80N | as req | | | M50D | 1.0 | 1.55 | none | | none | |
| 1-C | Control | | | | | | | | | | | | | | none | | none | |
| 1-C3 | Continuous | ASP | 0.2 | AP63 | 3.5 | APT | 0.15 | A80N | as req | | | | | 1.55 | TG 3530 | 0.5 | SCS | 0.5 |
| 1-C5 | Continuous | | | AP63 | 1 | APT | 0.15 | A80N | as req | | | M50D | 1.0 | 1.55 | none | | none | |
| 1-D | Control | | | | | | | | | | | | | | none | | none | |
| 1-D3 | Continuous | ASP | 0.2 | AP63 | 3.5 | APT | 0.15 | A80N | as req | | | | | 1.55 | TG 3530 | 0.5 | SCS | 0.5 |
| 1-D5 | Continuous | | | AP63 | 1 | APT | 0.15 | A80N | as req | | | M50D | 1.0 | 1.55 | none | | none | |
| 1-E | Control | | | | | | | | | | | | | | none | | none | |
| 1-E3 | Continuous | ASP | 0.2 | AP63 | 3.5 | APT | 0.15 | A80N | as req | | | | | 1.55 | TG 3530 | 0.5 | SCS | 0.5 |
| 1-E5 | Continuous | | | AP63 | 1 | APT | 0.15 | A80N | as req | | | M50D | 1.0 | 1.55 | none | | none | |
| 1-F | Control | | | | | | | | | | | | none | | none | | | |
| 1-F3 | Continuous | ASP | 0.2 | AP63 | 3.5 | APT | 0.15 | A80N | as req | | | | | 1.55 | TG 3530 | 0.5 | SCS | 0.5 |
| 1-F5 | Continuous | | | AP63 | 1 | APT | 0.15 | A80N | as req | | | M50D | 1.0 | 1.55 | none | | none | |

The indication "as req" denotes that a material was added to obtain a desired pH value.

TABLE 2

| Color Change Measurements | | | | | | | | | | | | | |
|---|---|---|---|---|---|---|---|---|---|---|---|---|---|
| | Visual Ratings Using ISO 105-A02 | | | | | | | ΔE Values Measured By Colorimeter | | | | | |
| Sample | 20% Clor | AR40 | Amm | Caustic 10 | Must | Total | WR | 20% Clor | AR40 | Amm | Caustic 10 | Must | Total |
| 1-A | 4.5 | 1 | 5 | 5 | 1 | 16.5 | F | 2.3 | 30.25 | 0.51 | 0.25 | 28.5 | 61.81 |
| 1-A3 | 5 | 5 | 5 | 5 | 4.5 | 24.5 | P | 0.91 | 1.62 | 0.62 | 0.45 | 2.7 | 6.3 |
| 1-A5 | 1 | 5 | 5 | 5 | 3 | 19 | P | 7.75 | 0.93 | 0.27 | 0.38 | 4.9 | 14.23 |
| 1-B | 4.5 | 1.5 | 5 | 5 | 1 | 17 | F | 1.3 | 24.35 | 0.68 | 0.83 | 33.99 | 61.15 |
| 1-B3 | 5 | 2.5 | 5 | 3 | 2 | 17.5 | P | 0.85 | 13.5 | 0.89 | 2.4 | 15.5 | 33.14 |
| 1-B5 | 5 | 1.5 | 5 | 5 | 2 | 18.5 | P | 0.4 | 29.7 | 0.09 | 0.31 | 17.9 | 48.4 |
| 1-C | 4.5 | 1 | 5 | 5 | 1 | 16.5 | F | 1.53 | 31.1 | 0.498 | 0.465 | 30.58 | 64.17 |
| 1-C3 | 4.5 | 5 | 5 | 4 | 4.5 | 23 | P | 2.61 | 0.41 | 0.3 | 0.82 | 2.6 | 6.74 |
| 1-C5 | 1 | 5 | 5 | 4.5 | 3.5 | 19 | P | 6.35 | 0.52 | 0.24 | 0.34 | 7.8 | 15.25 |
| 1-D | 4.5 | 2.5 | 5 | 5 | 1 | 18 | F | 0.92 | 7.99 | 0.494 | 1.46 | 60.14 | 71 |
| 1-D3 | 5 | 5 | 4 | 4 | 3.5 | 21.5 | P | 1.02 | 1.1 | 2.31 | 1.82 | 5.26 | 11.51 |
| 1-D5 | 5 | 5 | 5 | 5 | 1.5 | 21.5 | P | 0.52 | 0.51 | 1.5 | 0.48 | 16.3 | 19.31 |
| 1-E | 3.5 | 3 | 5 | 5 | 1.5 | 18 | F | 5.69 | 7.11 | 0.249 | 0.205 | 24.95 | 38.2 |
| 1-E3 | 4 | 5.0 | 5.0 | 5.0 | 4.5 | 23.5 | P | 3.32 | 1.01 | 0.43 | 0.39 | 1.6 | 6.75 |
| 1-E5 | 1.5 | 5 | 5 | 5 | 4.5 | 21 | P | 9.25 | 0.6 | 0.54 | 0.19 | 2.67 | 13.25 |
| 1-F | 5 | 3 | 5 | 5 | 1 | 19 | F | 0.43 | 8.67 | 0.76 | 0.55 | 40.4 | 50.81 |
| 1-F3 | 5 | 5 | 4.5 | 5 | 3 | 22.5 | P | 0.56 | 0.9 | 1.35 | 1.62 | 7.4 | 11.83 |
| 1-F5 | 5 | 5 | 5 | 5 | 2 | 22 | P | 0.33 | 0.26 | 0.77 | 0.5 | 9.6 | 11.46 |
| Total | 73.5 | 66.0 | 88.5 | 85.5 | 45.0 | 358.5 | | 46.0 | 160.5 | 12.5 | 13.5 | 312.8 | 545.3 |
| Average | 4.1 | 3.7 | 4.9 | 4.8 | 2.5 | 19.9 | | 2.6 | 8.9 | 0.7 | 0.7 | 17.4 | 30.3 |

Key:
20% Clor = the 20% Clorox test
AR40 = the AR40 Red Dye test
Amm = the Ammonia test
Caustic 10 = the Caustic 10% test
Must = the mustard test
WR = pass/fail for Visual test As shown in Table 2, ΔE values for samples of the present invention (i.e., Samples 1-A3, 1-B3, 1-C3, 1-D3, 1-E3 and 1-F3) were in every case lower than ΔE values for the control samples (i.e., Samples 1-A1, 1-B1, 1-C1, 1-D1, 1-E1, and 1-F1), which were untreated, and for the samples treated with only stain resist, APT, and fluorochemical in a single treatment step (i.e. Samples 1-A5, 1-B5, 1-C5, 1-D5, 1-E5, and 1-F5).

Example 2

Application of Tannic Acid-Containing Treatment Compositions

Carpet sample comprising greige 2099 were dyed using the above-described dyebath composition. The carpet samples were dyed using an Ahiba dyeing process as described above.

The carpet samples were then subjected to an aftertreatment composition with or without a topical spray composition using an Ahiba or continuous aftertreatment process as described above. Process variables are shown in Table 3 below.

The total wet pick-up during the aftertreatment step was about 400 wt % for each sample. The total steam time for each sample was 180 seconds. The total wet pick-up during the topical spray step was about 40 wt % for each sample exposed to the topical spray step.

Following the treatment steps, each sample was tested for discoloration using (i) the visual gray scale rating system, and (ii) color difference values (ΔE) as measured using a Macbeth 20/20 contact spectrophotometer. The results are shown in Table 4 below.

TABLE 3

Aftertreatment and Topical Spray Treatments

| | Aftertreatment Composition Components and Percent On Weight of Fiber | | | | | | | | |
|---|---|---|---|---|---|---|---|---|---|
| Sample | Aftertreat | C1 | % owf | C2 | % owf | C3 | % owf | C4 | % owf |
| 2-1A | Ahiba | ASP | 1.6 | Citric Acid | as req | | | | |
| 2-1B | Ahiba | ASP | 1.6 | Citric Acid | as req | | | | |
| 2-1C | Ahiba | ASP | 0.4 | APT | 0.15 | AP63 | 3.5 | | |
| 2-1D | Ahiba | ASP | 0.4 | APT | 0.15 | AP63 | 3.5 | | |
| 2-1E | Continuous | ASP | 2.5 | Eulysine S | as req | Acetic 80 | 0.5 | Isoprop | 0.5 |
| 2-1F | Continuous | ASP | 2.5 | Eulysine S | as req | Acetic 80 | 0.5 | Isoprop | 0.5 |
| 2-1G | Continuous | ASP | 2.5 | Eulysine S | as req | Acetic 80 | 0.5 | Isoprop | 0.5 |
| 2-1H | Continuous | ASP | 2.5 | Eulysine S | as req | Acetic 80 | 0.5 | Isoprop | 0.5 |
| 2-1I | Continuous | ASP | 0.4 | | | AP63 | 1 | | |
| 2-1J | Continuous | ASP | 0.4 | | | AP63 | 1 | | |
| 2-1K | Ahiba | ASP | 0.4 | APT | 0.15 | AP63 | 3.5 | | |
| 2-1L | Continuous | ASP | 0.4 | | | AP63 | 1 | | |

| | Aftertreatment Composition Components and Percent On Weight of Fiber | | | | | Topical Spray Composition Components and Percent On Weight of Fiber | | | |
|---|---|---|---|---|---|---|---|---|---|
| Sample | C5 | % owf | C6 | % owf | pH | C1 | % owf | C2 | % owf |
| 2-1A | | | | | 4 | none | | none | |
| 2-1B | | | TG 3530 | 0.5 | 4 | none | | none | |
| 2-1C | A80N | as req | | | 2.2 | none | | none | |
| 2-1D | A80N | as req | TG 3530 | 0.5 | 2.2 | none | | none | |
| 2-1E | | | | | 2.5 | none | | none | |
| 2-1F | Alum | 2.5 | | | 2.5 | none | | none | |
| 2-1G | | | TG 3530 | 0.5 | 2.5 | none | | none | |
| 2-1H | Alum | 2.5 | TG 3530 | 0.5 | 2.5 | none | | none | |
| 2-1I | A80N | as req | | | 1.55 | none | | none | |
| 2-1J | A80N | as req | TG3530 | 0.5 | 1.55 | none | | none | |
| 2-1K | A80N | as req | | | 2.2 | SCS | 0.5 | TG 3530 | 0.5 |
| 2-1L | A80N | as req | | | 1.55 | SCS | 0.5 | TG 3530 | 0.5 |

TABLE 4

Color Change Measurements

| | Visual Ratings Using ISO 105-A02 | | | | | | | ΔE Values Measured By Calorimeter | | | | | |
|---|---|---|---|---|---|---|---|---|---|---|---|---|---|
| Sample | 20% Clor | AR40 | Amm | Caustic 10 | Must | Total | WR | 20% Clor | AR40 | Amm | Caustic 10 | Must | Total |
| 2-1A | 2 | 2 | 4 | 1.5 | 1 | 10.5 | F | 5.5 | 20.6 | 4.3 | 16.2 | 58.3 | 104.9 |
| 2-1B | 2 | 1.5 | 3.5 | 1 | 1 | 9 | F | 4.3 | 32.6 | 9.2 | 26.6 | 60.4 | 133.1 |
| 2-1C | 2.5 | 4 | 4.5 | 2 | 2 | 15 | F | 7.5 | 3.4 | 2.8 | 16.5 | 21 | 51.2 |
| 2-1D | 2.5 | 4.5 | 4.5 | 2 | 2 | 15.5 | F | 7.4 | 2.3 | 2 | 15.7 | 28.9 | 56.3 |
| 2-1E | 3 | 2 | 3 | 1.5 | 1 | 10.5 | F | 6.1 | 20.3 | 5.9 | 16.4 | 59.7 | 108.4 |
| 2-1F | 2.5 | 3.5 | 3.5 | 1 | 1 | 11.5 | F | 7.5 | 6.2 | 3.5 | 16.7 | 47 | 80.9 |
| 2-1G | 3.5 | 2 | 3 | 1 | 1 | 10.5 | F | 5.6 | 15.4 | 5.8 | 16.2 | 47.1 | 90.1 |
| 2-1H | 2.5 | 3 | 3.5 | 1 | 1 | 11 | F | 5.7 | 5.6 | 3.9 | 15.3 | 48 | 78.5 |
| 2-1I | 2.5 | 3 | 3.5 | 2 | 1 | 12 | F | 10.3 | 5.7 | 5.4 | 18.9 | 52.9 | 93.2 |
| 2-1J | 1 | 4.5 | 3.5 | 1 | 2 | 12 | P | 6 | 2.7 | 7 | 21.7 | 15.2 | 52.6 |
| 2-1K | 4 | 4 | 5 | 2 | 3 | 18 | P | 6.5 | 1.7 | 1.8 | 9.4 | 11.9 | 31.3 |
| 2-1L | 2 | 4 | 4.5 | 1.5 | 2 | 14 | P | 6.2 | 2.6 | 1.9 | 6.1 | 19.1 | 35.9 |
| Total | 30 | 38 | 46 | 17.5 | 18 | 149.5 | | 78.6 | 119.1 | 53.5 | 195.7 | 469.5 | 916.4 |
| Average | 2.5 | 3.2 | 3.8 | 1.5 | 1.5 | 12.5 | | 6.55 | 9.9 | 4.5 | 16.3 | 39.1 | 76.4 |
| Control | 1 | 1 | 5 | 5 | 1 | 13 | F | 7.8 | 34.2 | 0.38 | 0.33 | 70.5 | 113.2 |

As shown in Table 4, ΔE values for samples of the present invention (i.e., Samples 2-1C, 2-1D, 2-1J, 2-1K and 2-1L) were in every case lower than ΔE values for the remaining samples, which were treated with tannic acid and one or more additional components that desirably are not present in the aqueous treatment compositions of the present invention, such as citric acid, polyacrylic acid, acetic acid, isopropanol, and alum.

Example 3

Application of Tannic Acid-Containing Treatment Compositions

Example 2 was repeated except that tannic acid 3SP was used in place of tannic acid ASP. Process variables for Example 3 are shown in Table 5 below. Discoloration results are shown in Table 6 below.

TABLE 5

Aftertreatment and Topical Spray Treatments

| | Aftertreatment Composition Components and Percent On Weight of Fiber | | | | | | | | |
|---|---|---|---|---|---|---|---|---|---|
| Sample | Aftertreat | C1 | % owf | C2 | % owf | C3 | % owf | C4 | % owf |
| 3-2A | Ahiba | 3SP | 1.6 | Citric Acid | as req | | | | |
| 3-2B | Ahiba | 3SP | 1.6 | Citric Acid | as req | | | | |
| 3-2C | Ahiba | 3SP | 0.4 | APT | 0.15 | AP63 | 3.5 | | |
| 3-2D | Ahiba | 3SP | 0.4 | APT | 0.15 | AP63 | 3.5 | | |
| 3-2E | Continuous | 3SP | 2.5 | Eulysine S | as req | Acetic 80 | 0.5 | Isoprop | 0.5 |
| 3-2F | Continuous | 3SP | 2.5 | Eulysine S | as req | Acetic 80 | 0.5 | Isoprop | 0.5 |
| 3-2G | Continuous | 3SP | 2.5 | Eulysine S | as req | Acetic 80 | 0.5 | Isoprop | 0.5 |
| 3-2H | Continuous | 3SP | 2.5 | Eulysine S | as req | Acetic 80 | 0.5 | Isoprop | 0.5 |
| 3-2I | Continuous | 3SP | 0.4 | | | AP63 | 1 | | |
| 3-2J | Continuous | 3SP | 0.4 | | | AP63 | 1 | | |
| 3-2K | Ahiba | 3SP | 0.4 | APT | 0.15 | AP63 | 3.5 | | |
| 3-2L | Continuous | 3SP | 0.4 | | | AP63 | 1 | | |

| | Aftertreatment Composition Components and Percent On Weight of Fiber | | | | | Topical Spray Composition Components and Percent On Weight of Fiber | | | |
|---|---|---|---|---|---|---|---|---|---|
| Sample | C5 | % owf | C6 | % owf | pH | C1 | % owf | C2 | % owf |
| 3-2A | | | | | 4 | none | | none | |
| 3-2B | | | TG 3530 | 0.5 | 4 | none | | none | |
| 3-2C | A80N | as req | | | 2.2 | none | | none | |
| 3-2D | A80N | as req | TG 3530 | 0.5 | 2.2 | none | | none | |
| 3-2E | | | | | 2.5 | none | | none | |
| 3-2F | Alum | 2.5 | | | 2.5 | none | | none | |
| 3-2G | | | TG 3530 | 0.5 | 2.5 | none | | none | |
| 3-2H | Alum | 2.5 | TG 3530 | 0.5 | 2.5 | none | | none | |
| 3-2I | A80N | as req | | | 1.55 | none | | none | |
| 3-2J | A80N | as req | TG 3530 | 0.5 | 1.55 | none | | none | |
| 3-2K | A80N | as req | | | 2.2 | SCS | 0.5 | TG 3530 | 0.5 |
| 3-2L | A80N | as req | | | 1.55 | SCS | 0.5 | TG 3530 | 0.5 |

TABLE 6

| Color Change Measurements | | | | | | | | | | | | | |
|---|---|---|---|---|---|---|---|---|---|---|---|---|---|
| | Visual Ratings Using ISO 105-A02 | | | | | | | ΔE Values Measured By Colorimeter | | | | | |
| Sample | 20% Clor | AR40 | Amm | Caustic 10 | Must | Total | WR | 20% Clor | AR40 | Amm | Caustic 10 | Must | Total |
| 3-2A | 2 | 2.5 | 3 | 1.5 | 1 | 10 | F | 7.3 | 9.2 | 5.6 | 14.2 | 39.7 | 76 |
| 3-2B | 1 | 1.5 | 1.5 | 1 | 1 | 6 | P | 5.4 | 27.3 | 18.4 | 27.7 | 43 | 121.8 |
| 3-2C | 2 | 4.5 | 4.5 | 2.5 | 2 | 15.5 | F | 10.2 | 2.3 | 4.6 | 17 | 23 | 57.1 |
| 3-2D | 2 | 4.5 | 4.5 | 2 | 2 | 15 | F | 8.3 | 1.5 | 4.2 | 14.8 | 18.6 | 47.4 |
| 3-2E | 2.5 | 2 | 2.5 | 1 | 1 | 9 | F | 8.2 | 18.2 | 7.9 | 15.5 | 57.2 | 107 |
| 3-2F | 2 | 2 | 2.5 | 1 | 1 | 8.5 | F | 9.9 | 13.9 | 5.8 | 19.9 | 46.6 | 96.1 |
| 3-2G | 2.5 | 1.5 | 2.5 | 1 | 1 | 8.5 | F | 5.9 | 24.3 | 8.1 | 16.4 | 32.8 | 87.5 |
| 3-2H | 2 | 2.5 | 2.5 | 1 | 1 | 9 | F | 7.5 | 8.3 | 7.1 | 14.4 | 45.1 | 82.4 |
| 3-2I | 2.5 | 2.5 | 3 | 1.5 | 1 | 10.5 | F | 6.9 | 8.8 | 4.3 | 13.1 | 49.3 | 82.4 |
| 3-2J | 1 | 4 | 2.5 | 1 | 1 | 9.5 | P | 6.6 | 2.2 | 8.1 | 21.7 | 17 | 55.6 |
| 3-2K | 2.5 | 4 | 4.5 | 1.5 | 2.5 | 15 | P | 12.2 | 2.4 | 2.8 | 13.3 | 14.8 | 45.5 |
| 3-2L | 3 | 3.5 | 4.5 | 1.5 | 2 | 14.5 | P | 7.3 | 2.55 | 4.1 | 12.7 | 29.4 | 56.05 |
| Total | 25 | 35 | 38 | 16.5 | 16.5 | 131 | | 95.7 | 120.95 | 81 | 200.7 | 416.5 | 914.85 |
| Average | 2.1 | 2.9 | 3.2 | 1.4 | 1.4 | 10.9 | | 8.0 | 10.1 | 6.8 | 16.7 | 34.7 | 76.2 |

As shown in Table 6, ΔE values for samples of the present invention (i.e., Samples 3-2C, 3-2D, 3-2J, 3-2K and 3-2L) were in every case lower than ΔE values for the remaining samples, which were treated with tannic acid and one or more additional components that desirably are not present in the aqueous treatment compositions of the present invention, such as citric acid, polyacrylic acid, acetic acid, isopropanol, and alum.

Example 4

Application of Tannic Acid-Containing Treatment Compositions

Example 2 was repeated except that tannic acid CLM was used in place of tannic acid ASP. Process variables for Example 4 are shown in Table 7 below. Discoloration results are shown in Table 8 below.

TABLE 7

| Aftertreatment and Topical Spray Treatments | | | | | | | | | |
|---|---|---|---|---|---|---|---|---|---|
| | Aftertreatment Composition Components and Percent On Weight of Fiber | | | | | | | | |
| Sample | Aftertreat | C1 | % owf | C2 | % owf | C3 | % owf | C4 | % owf |
| 4-3A | Ahiba | CLM | 1.6 | Citric Acid | as req | | | | |
| 4-3B | Ahiba | CLM | 1.6 | Citric Acid | as req | | | | |
| 4-3C | Ahiba | CLM | 0.4 | APT | 0.15 | AP63 | 3.5 | | |
| 4-3D | Ahiba | CLM | 0.4 | APT | 0.15 | AP63 | 3.5 | | |
| 4-3E | Continuous | CLM | 2.5 | Eulysine S | as req | Acetic 80 | 0.5 | Isoprop | 0.5 |
| 4-3F | Continuous | CLM | 2.5 | Eulysine S | as req | Acetic 80 | 0.5 | Isoprop | 0.5 |
| 4-3G | Continuous | CLM | 2.5 | Eulysine S | as req | Acetic 80 | 0.5 | Isoprop | 0.5 |
| 4-3H | Continuous | CLM | 2.5 | Eulysine S | as req | Acetic 80 | 0.5 | Isoprop | 0.5 |
| 4-3I | Continuous | CLM | 0.4 | | | AP63 | 1 | | |
| 4-3J | Continuous | CLM | 0.4 | | | AP63 | 1 | | |
| 4-3K | Ahiba | CLM | 0.4 | APT | 0.15 | AP63 | 3.5 | | |
| 4-3L | Continuous | CLM | 0.4 | | | AP63 | 1 | | |

| | Aftertreatment Composition Components and Percent On Weight of Fiber | | | | | Topical Spray Composition Components and Percent On Weight of Fiber | | | |
|---|---|---|---|---|---|---|---|---|---|
| Sample | C5 | % owf | C6 | % owf | pH | C1 | % owf | C2 | % owf |
| 4-3A | | | | | 4 | none | | none | |
| 4-3B | | | TG 3530 | 0.5 | 4 | none | | none | |

TABLE 7-continued

| Aftertreatment and Topical Spray Treatments | | | | | | | | | |
|---|---|---|---|---|---|---|---|---|---|
| 4-3C | A80N | as req | | | 2.2 | none | | none | |
| 4-3D | A80N | as req | TG 3530 | 0.5 | 2.2 | none | | none | |
| 4-3E | | | | | 2.5 | none | | none | |
| 4-3F | Alum | 2.5 | | | 2.5 | none | | none | |
| 4-3G | | | TG 3530 | 0.5 | 2.5 | none | | none | |
| 4-3H | Alum | 2.5 | TG 3530 | 0.5 | 2.5 | none | | none | |
| 4-3I | A80N | as req | | | 1.55 | none | | none | |
| 4-3J | A80N | as req | TG 3530 | 0.5 | 1.55 | none | | none | |
| 4-3K | A80N | as req | | | 2.2 | SCS | 0.5 | TG 3530 | 0.5 |
| 4-3L | A80N | as req | | | 1.55 | SCS | 0.5 | TG 3530 | 0.5 |

TABLE 8

| Color Change Measurements | | | | | | | | | | | | |
|---|---|---|---|---|---|---|---|---|---|---|---|---|
| | Visual Ratings Using ISO 105-A02 | | | | | | ΔE Values Measured By Colorimeter | | | | | |
| Sample | 20% Clor | AR40 | Amm | Caustic 10 | Must | Total | 20% Clor | AR40 | Amm | Caustic 10 | Must | Total |
| 4-3A | 1.5 | 2.5 | 1.5 | 1.5 | 1 | 8 | 9.52 | 8.8 | 18.5 | 18.3 | 49.7 | 104.82 |
| 4-3B | 2 | 1.5 | 2.5 | 1 | 1 | 8 | 3 | 16.5 | 5.7 | 24.8 | 33.2 | 83.2 |
| 4-3C | 2 | 4.5 | 4 | 2 | 2.5 | 15 | 9.6 | 1.35 | 3.7 | 17.1 | 18.4 | 50.15 |
| 4-3D | 1.5 | 4.5 | 4 | 1.5 | 2 | 13.5 | 9.5 | 2.9 | 4.5 | 16 | 23.4 | 56.3 |
| 4-3E | 2.5 | 2 | 2.5 | 1 | 1 | 9 | 6.6 | 13.4 | 7.2 | 20.9 | 46.4 | 94.5 |
| 4-3F | 2 | 2 | 2.5 | 1.5 | 1 | 9 | 7.4 | 12.9 | 6.4 | 13.3 | 26.7 | 66.7 |
| 4-3G | 3 | 1.5 | 2.5 | 1 | 1.5 | 9.5 | 4.5 | 21.6 | 5.4 | 16 | 23.8 | 71.3 |
| 4-3H | 2 | 2.5 | 2.5 | 1.5 | 1 | 9.5 | 7.3 | 8.2 | 7.8 | 11.7 | 32.8 | 67.8 |
| 4-3I | 2 | 2.5 | 3.5 | 1.5 | 1 | 10.5 | 9.7 | 5.9 | 5.8 | 15.5 | 53 | 89.9 |
| 4-3J | 1 | 3.5 | 2.5 | 1 | 1.5 | 9.5 | 6.55 | 6.1 | 7.6 | 25.6 | 28.3 | 74.15 |
| 4-3K | 2.5 | 4 | 4 | 1.5 | 2 | 14 | 10.1 | 1.5 | 4.3 | 13.3 | 17 | 46.2 |
| 4-3L | 2.5 | 3.5 | 4 | 1.5 | 1.5 | 13 | 4.4 | 3.1 | 3.4 | 11.9 | 35.3 | 58.1 |
| Total | 24.5 | 34.5 | 36 | 16.5 | 17 | 128.5 | 88.17 | 102.25 | 80.3 | 204.4 | 388 | 863.12 |
| Average | 2.0 | 2.9 | 3.0 | 1.4 | 1.4 | 10.7 | 7.3 | 8.5 | 6.7 | 17.0 | 32.3 | 71.9 |

As shown in Table 8, ΔE values for samples of the present invention (i.e., Samples 4-3C, 4-3D, 4-3J, 4-3K and 4-3L) were in every case lower than ΔE values for the remaining samples, which were treated with tannic acid and one or more additional components that desirably are not present in the aqueous treatment compositions of the present invention, such as citric acid, polyacrylic acid, acetic acid, isopropanol, and alum.

Example 5

Application of Tannic Acid-Containing Treatment Compositions

Example 2 was repeated except that BAYGARD® CL tannic acid solution was used in place of tannic acid ASP. Process variables for Example 5 are shown in Table 9 below. Discoloration results are shown in Table 10 below.

TABLE 9

| Aftertreatment and Topical Spray Treatments | | | | | | | | | |
|---|---|---|---|---|---|---|---|---|---|
| | Aftertreatment Composition Components and Percent On Weight of Fiber | | | | | | | | |
| Sample | Aftertreat | C1 | % owf | C2 | % owf | C3 | % owf | C4 | % owf |
| 5-4A | Ahiba | Bay CL L | 4.8 | Citric Acid | as req | | | | |
| 5-4B | Ahiba | Bay CL L | 4.8 | Citric Acid | as req | | | | |
| 5-4C | Ahiba | Bay CL L | 1.2 | APT | 0.15 | AP63 | 3.5 | | |
| 5-4D | Ahiba | Bay CL L | 1.2 | APT | 0.15 | AP63 | 3.5 | | |
| 5-4E | Continuous | Bay CL L | 7.5 | Eulysine S | as req | Acetic 80 | 0.5 | Isoprop | 0.5 |
| 5-4F | Continuous | Bay CL L | 7.5 | Eulysine S | as req | Acetic 80 | 0.5 | Isoprop | 0.5 |
| 5-4G | Continuous | Bay CL L | 7.5 | Eulysine S | as req | Acetic 80 | 0.5 | Isoprop | 0.5 |
| 5-4H | Continuous | Bay CL L | 7.5 | Eulysine S | as req | Acetic 80 | 0.5 | Isoprop | 0.5 |

TABLE 9-continued

| Aftertreatment and Topical Spray Treatments | | | | | | | |
|---|---|---|---|---|---|---|---|
| 5-4I | Continuous | Bay CL L | 1.2 | | | AP63 | 1 |
| 5-4J | Continuous | Bay CL L | 1.2 | | | AP63 | 1 |
| 5-4K | Ahiba | Bay CL L | 1.2 | APT | 0.15 | AP63 | 3.5 |
| 5-4L | Continuous | Bay CL L | 1.2 | | | AP63 | 1 |

| | Aftertreatment Composition Components and Percent On Weight of Fiber | | | | | Topical Spray Composition Components and Percent On Weight of Fiber | | | |
|---|---|---|---|---|---|---|---|---|---|
| Sample | C5 | % owf | C6 | % owf | pH | C1 | % owf | C2 | % owf |
| 5-4A | | | | | 4 | none | | none | |
| 5-4B | | | TG 3530 | 0.5 | 4 | none | | none | |
| 5-4C | A80N | as req | | | 2.2 | none | | none | |
| 5-4D | A80N | as req | TG 3530 | 0.5 | 2.2 | none | | none | |
| 5-4E | | | | | 2.5 | none | | none | |
| 5-4F | Alum | 2.5 | | | 2.5 | none | | none | |
| 5-4G | | | TG 3530 | 0.5 | 2.5 | none | | none | |
| 5-4H | Alum | 2.5 | TG 3530 | 0.5 | 2.5 | none | | none | |
| 5-4I | A80N | as req | | | 1.55 | none | | none | |
| 5-4J | A80N | as req | TG 3530 | 0.5 | 1.55 | none | | none | |
| 5-4K | A80N | as req | | | 2.2 | SCS | 0.5 | TG 3530 | 0.5 |
| 5-4L | A80N | as req | | | 1.55 | SCS | 0.5 | TG 3530 | 0.5 |

TABLE 10

Color Change Measurements

| | Visual Ratings Using ISO 105-A02 | | | | | | | ΔE Values Measured By Colorimeter | | | | | |
|---|---|---|---|---|---|---|---|---|---|---|---|---|---|
| Sample | 20% Clor | AR40 | Amm | Caustic 10 | Must | Total | WR | 20% Clor | AR40 | Amm | Caustic 10 | Must | Total |
| 5-4A | 1.5 | 2.5 | 2.5 | 1.5 | 1 | 9 | F | 8.9 | 5.5 | 6.05 | 21.1 | 39 | 80.55 |
| 5-4B | 1.5 | 1.5 | 2 | 1 | 1.5 | 7.5 | P | 4.7 | 24.8 | 7.7 | 23 | 24.2 | 84.4 |
| 5-4C | 2 | 4.5 | 4.5 | 2 | 2 | 15 | F | 7.9 | 1.44 | 2.7 | 15.1 | 20.3 | 47.44 |
| 5-4D | 2 | 3.5 | 4 | 1.5 | 2 | 13 | F | 6.8 | 2.1 | 1.97 | 13.4 | 23.1 | 47.37 |
| 5-4E | 2.5 | 1.5 | 3 | 1 | 1 | 9 | F | 6 | 23.6 | 5.3 | 22.4 | 47.5 | 104.8 |
| 5-4F | 2 | 2 | 3 | 1.5 | 1 | 9.5 | F | 6.1 | 13.7 | 5.9 | 10.1 | 31.6 | 67.4 |
| 5-4G | 3 | 1.5 | 3.5 | 1 | 1.5 | 10.5 | P | 5.4 | 22.4 | 6.3 | 21.9 | 28.9 | 84.9 |
| 5-4H | 2.5 | 2.5 | 2.5 | 1.5 | 1 | 10 | F | 7.5 | 7.1 | 5.3 | 11.5 | 35.7 | 67.1 |
| 5-4I | 2.5 | 2 | 3 | 1.5 | 1 | 10 | F | 8.8 | 10.9 | 6.3 | 17.5 | 55.6 | 99.1 |
| 5-4J | 1 | 2.5 | 2.5 | 1 | 1.5 | 8.5 | P | 6.4 | 9.1 | 7.2 | 25.5 | 23.1 | 71.3 |
| 5-4K | 1 | 4 | 4 | 1.5 | 2 | 12.5 | P | 13 | 3.3 | 1.9 | 16 | 13.6 | 47.8 |
| 5-4L | 1.5 | 3 | 3.5 | 1.5 | 2 | 11.5 | P | 8.4 | 9.7 | 5.3 | 5.1 | 21.9 | 50.4 |
| Total | 23 | 31 | 38 | 16.5 | 17.5 | 126 | | 89.9 | 133.64 | 61.92 | 202.6 | 364.5 | 852.56 |
| Average | 1.9 | 2.6 | 3.2 | 1.4 | 1.5 | 10.5 | | 7.5 | 11.1 | 5.2 | 16.9 | 30.4 | 71.0 |

As shown in Table 10, ΔE values for samples of the present invention (i.e., Samples 5-4C, 5-4D, 5-4J, 5-4K and 5-4L) were in most every case lower than ΔE values for the remaining samples, which were treated with tannic acid and one or more additional components that desirably are not present in the aqueous treatment compositions of the present invention, such as citric acid, polyacrylic acid, acetic acid, isopropanol, and alum.

Example 6

Application of Tannic Acid-Containing Treatment Compositions

Carpet sample comprising greige 2099 were dyed using the above-described dyebath composition. The carpet samples were dyed using an Ahiba dyeing process as described above. The carpet samples were then subjected to an aftertreatment composition with or without a topical spray composition using an Ahiba or continuous process as described above. Process variables are shown in Table 11 below.

The total wet pick-up during the aftertreatment step was about 400 wt % for each sample. The total steam time for each sample was 180 seconds. The total wet pick-up during the topical spray step was about 40 wt % for each sample exposed to the topical spray step.

Following the treatment steps, each sample was tested for discoloration using (i) the visual gray scale rating system, and (ii) color difference values (ΔE) as measured using a Macbeth 20/20 contact spectrophotometer. The results are shown in Table 12 below.

TABLE 11

Aftertreatment and Topical Spray Treatments

| | Aftertreatment Composition Components and Percent On Weight of Fiber | | | | | | | |
|---|---|---|---|---|---|---|---|---|
| Sample | Aftertreat | C1 | % owf | C2 | % owf | C3 | % owf | C4 |
| 6-1A | Ahiba | ASP | 1.6 | Citric Acid | as req | | | |
| 6-2A | Ahiba | ASP | 1.6 | Citric Acid | as req | | | |
| 6-3A | Ahiba | ASP | 1.6 | Citric Acid | as req | | | |
| 6-4A | Ahiba | ASP | 0.4 | APT | 0.15 | AP63 | 3.5 | |
| 6-5A | Ahiba | ASP | 0.4 | APT | 0.15 | AP63 | 3.5 | |
| 6-6A | Ahiba | ASP | 0.4 | APT | 0.15 | AP63 | 3.5 | |
| 6-7A | Continuous | ASP | 2.5 | Eulysine S | as req | Acetic 80 | 0.5 | Isoprop |
| 6-8A | Continuous | ASP | 2.5 | Eulysine S | as req | Acetic 80 | 0.5 | Isoprop |
| 6-9A | Continuous | ASP | 2.5 | Eulysine S | as req | Acetic 80 | 0.5 | Isoprop |
| 6-10A | Continuous | ASP | 2.5 | Eulysine S | as req | Acetic 80 | 0.5 | Isoprop |
| 6-11A | Continuous | ASP | 2.5 | Eulysine S | as req | Acetic 80 | 0.5 | Isoprop |
| 6-12A | Continuous | ASP | 2.5 | Eulysine S | as req | Acetic 80 | 0.5 | Isoprop |
| 6-13A | Continuous | ASP | 0.4 | | | AP63 | 1 | |
| 6-14A | Continuous | ASP | 0.4 | | | AP63 | 1 | |
| 6-15A | Continuous | ASP | 0.4 | | | AP63 | 1 | |
| 6-16A | Continuous | ASP | 0.4 | | | AP63 | 1 | |
| 6-17A | Continuous | ASP | 0.4 | | | AP63 | 1 | |
| 6-18A | Continuous | ASP | 0.4 | | | AP63 | 1 | |

| | Aftertreatment Composition Components and Percent On Weight of Fiber | | | | | | Topical Spray Composition Components and Percent On Weight of Fiber | | | |
|---|---|---|---|---|---|---|---|---|---|---|
| Sample | % owf | C5 | % owf | C6 | % owf | pH | C1 | % owf | C2 | % owf |
| 6-1A | | | | | | 4 | SCS | 0.5 | TG 3530 | 0.5 |
| 6-2A | | | | | | 4 | SCS | 0.5 | none | |
| 6-3A | | | | | | 4 | none | | TG 3530 | 0.5 |
| 6-4A | | A80N | as req | | | 2.2 | SCS | 0.5 | TG 3530 | 0.5 |
| 6-5A | | A80N | as req | | | 2.2 | SCS | 0.5 | none | |
| 6-6A | | A80N | as req | | | 2.2 | none | | TG 3530 | 0.5 |
| 6-7A | 0.5 | | | | | 2.5 | SCS | 0.5 | TG 3530 | 0.5 |
| 6-8A | 0.5 | | | | | 2.5 | SCS | 0.5 | none | |
| 6-9A | 0.5 | | | | | 2.5 | none | | TG 3530 | 0.5 |
| 6-10A | 0.5 | Alum | 2.5 | | | 2.5 | SCS | 0.5 | TG 3530 | 0.5 |
| 6-11A | 0.5 | Alum | 2.5 | | | 2.5 | SCS | 0.5 | none | |
| 6-12A | 0.5 | Alum | 2.5 | | | 2.5 | none | | TG 3530 | 0.5 |
| 6-13A | | A80N | as req | | | 1.55 | SCS | 0.5 | TG 3530 | 0.5 |
| 6-14A | | A80N | as req | | | 1.55 | SCS | 0.5 | none | |
| 6-15A | | A80N | as req | | | 1.55 | none | | TG 3530 | 0.5 |
| 6-16A | | A80N | as req | TG 3530 | 0.5 | 1.55 | SCS | 0.5 | TG 3530 | 0.5 |
| 6-17A | | A80N | as req | TG 3530 | 0.5 | 1.55 | SCS | 0.5 | none | |
| 6-18A | | A80N | as req | TG 3530 | 0.5 | 1.55 | none | | TG 3530 | 0.5 |

TABLE 12

Color Change Measurements

| Sample | Visual Ratings Using ISO 105-A02 | | | | | | | ΔE Values Measured By Colorimeter | | | | | |
|---|---|---|---|---|---|---|---|---|---|---|---|---|---|
| | 20% Clor | AR40 | Amm | Caustic 10 | Must | Total | WR | 20% Clor | AR40 | Amm | Caustic 10 | Must | Total |
| 6-1A | 2.5 | 4 | 4 | 3 | 1.5 | 15 | P | 8.08 | 3.34 | 5.7 | 6.2 | 31.2 | 54.52 |
| 6-2A | 2 | 2 | 3.5 | 1.5 | 1 | 10 | F | 11.1 | 6.51 | 5.52 | 20.2 | 65.06 | 108.39 |
| 6-3A | 2.5 | 3 | 3.5 | 1 | 1 | 11 | P | 9.05 | 6.43 | 8.77 | 23.35 | 46.99 | 94.59 |
| 6-4A | 3 | 4.5 | 5 | 4.5 | 2 | 19 | P | 5.97 | 1.13 | 1.56 | 4.16 | 16.79 | 29.61 |
| 6-5A | 2.5 | 3 | 5 | 2.5 | 1.5 | 14.5 | F | 11.36 | 5.42 | 2.39 | 12.56 | 39.1 | 70.83 |
| 6-6A | 2 | 4.5 | 4.5 | 1.5 | 2 | 14.5 | P | 10.44 | 1.39 | 0.86 | 27.09 | 19.54 | 59.32 |
| 6-7A | 3.5 | 4 | 3 | 1.5 | 2.5 | 14.5 | P | 4.01 | 2.49 | 6.82 | 18.06 | 6.1 | 37.48 |
| 6-8A | 2 | 3 | 3 | 1.5 | 1 | 10.5 | F | 8.6 | 6 | 5.94 | 19.99 | 34.39 | 74.92 |
| 6-9A | 2 | 2 | 2.5 | 1 | 3 | 10.5 | P | 6.08 | 8.77 | 9.63 | 13.36 | 5.12 | 42.96 |
| 6-10A | 2.5 | 4.5 | 4 | 1.5 | 2.5 | 15 | P | 7.4 | 0.909 | 3.66 | 12.82 | 10.28 | 35.07 |
| 6-11A | 2 | 3.5 | 4 | 1.5 | 1 | 12 | F | 8.07 | 2.71 | 2.78 | 13.75 | 30.07 | 57.38 |
| 6-12A | 2 | 3 | 3.5 | 1.5 | 2.5 | 12.5 | P | 6.26 | 6.13 | 6.25 | 15.74 | 7.94 | 42.32 |
| 6-13A | 3.5 | 3.5 | 4 | 2.5 | 2.5 | 16 | P | 6.39 | 7.21 | 3.95 | 6.01 | 6.97 | 30.53 |
| 6-14A | 2.5 | 2.5 | 4 | 2 | 1.5 | 12.5 | F | 8.93 | 9.43 | 2.48 | 10.78 | 30.53 | 62.15 |
| 6-15A | 3.5 | 3.5 | 4 | 1.5 | 2.5 | 15 | P | 3.41 | 3.78 | 5.28 | 19.76 | 8.56 | 40.79 |
| 6-16A | 4 | 3 | 5 | 2 | 2.5 | 16.5 | P | 0.6 | 8.46 | 1.64 | 8.26 | 9.68 | 28.64 |
| 6-17A | 2 | 3 | 4 | 1.5 | 2 | 12.5 | P | 3.99 | 7.96 | 3.97 | 20.33 | 6.04 | 42.29 |
| 6-18A | 3 | 4 | 4 | 1 | 2.5 | 14.5 | P | 2.17 | 1.71 | 4.63 | 18.46 | 5.18 | 32.15 |
| Total | 47 | 60.5 | 70.5 | 33 | 35 | 246 | | 121.91 | 89.779 | 81.83 | 270.88 | 379.54 | 943.939 |
| Average | 2.6 | 3.4 | 3.9 | 1.8 | 1.9 | 13.7 | | 6.8 | 5.0 | 4.5 | 15.0 | 21.1 | 52.4 |
| Control | 1 | 1 | 5 | 5 | 1 | 13 | F | 7.8 | 34.2 | 0.38 | 0.33 | 70.5 | 113.21 |

As shown in Table 12, ΔE values for samples that were treated topically using the combination of a fluorochemical and a crosslinking agent (i.e., Samples 6-1A, 6-4A, 6-7A, 6-10A, 6-13A, and 6-16A) were in almost every case lower than ΔE values for the associated samples that were not topically treated with the combination of both a fluorochemical compound and a crosslinking agent.

Example 7

Application of Tannic Acid-Containing Treatment Compositions

Example 6 was repeated except that tannic acid 3SP was used in place of tannic acid ASP. Process variables for Example 7 are shown in Table 13 below. Discoloration results are shown in Table 14 below.

TABLE 13

Aftertreatment and Topical Spray Treatments

| Sample | Aftertreatment Composition Components and Percent On Weight of Fiber | | | | | | | |
|---|---|---|---|---|---|---|---|---|
| | Aftertreat | C1 | % owf | C2 | % owf | C3 | % owf | C4 |
| 7-1B | Ahiba | 3SP | 1.6 | Citric Acid | as req | | | |
| 7-2B | Ahiba | 3SP | 1.6 | Citric Acid | as req | | | |
| 7-3B | Ahiba | 3SP | 1.6 | Citric Acid | as req | | | |
| 7-4B | Ahiba | 3SP | 0.4 | APT | 0.15 | AP63 | 3.5 | |
| 7-5B | Ahiba | 3SP | 0.4 | APT | 0.15 | AP63 | 3.5 | |
| 7-6B | Ahiba | 3SP | 0.4 | APT | 0.15 | AP63 | 3.5 | |
| 7-7B | Continuous | 3SP | 2.5 | Eulysine S | as req | Acetic 80 | 0.5 | Isoprop |
| 7-8B | Continuous | 3SP | 2.5 | Eulysine S | as req | Acetic 80 | 0.5 | Isoprop |
| 7-9B | Continuous | 3SP | 2.5 | Eulysine S | as req | Acetic 80 | 0.5 | Isoprop |
| 7-10B | Continuous | 3SP | 2.5 | Eulysine S | as req | Acetic 80 | 0.5 | Isoprop |
| 7-11B | Continuous | 3SP | 2.5 | Eulysine S | as req | Acetic 80 | 0.5 | Isoprop |
| 7-12B | Continuous | 3SP | 2.5 | Eulysine S | as req | Acetic 80 | 0.5 | Isoprop |
| 7-13B | Continuous | 3SP | 0.4 | | | AP63 | 1 | |
| 7-14B | Continuous | 3SP | 0.4 | | | AP63 | 1 | |

TABLE 13-continued

| Aftertreatment and Topical Spray Treatments | | | | | | |
|---|---|---|---|---|---|---|
| 7-15B | Continuous | 3SP | 0.4 | | AP63 | 1 |
| 7-16B | Continuous | 3SP | 0.4 | | AP63 | 1 |
| 7-17B | Continuous | 3SP | 0.4 | | AP63 | 1 |
| 7-18B | Continuous | 3SP | 0.4 | | AP63 | 1 |

| | Aftertreatment Composition Components and Percent On Weight of Fiber | | | | | | Topical Spray Composition Components and Percent On Weight of Fiber | | | |
|---|---|---|---|---|---|---|---|---|---|---|
| Sample | % owf | C5 | % owf | C6 | % owf | pH | C1 | % owf | C2 | % owf |
| 7-1B | | | | | | 4 | SCS | 0.5 | TG 3530 | 0.5 |
| 7-2B | | | | | | 4 | SCS | 0.5 | none | |
| 7-3B | | | | | | 4 | none | | TG 3530 | 0.5 |
| 7-4B | | A80N | as req | | | 2.2 | SCS | 0.5 | TG 3530 | 0.5 |
| 7-5B | | A80N | as req | | | 2.2 | SCS | 0.5 | none | |
| 7-6B | | A80N | as req | | | 2.2 | none | | TG 3530 | 0.5 |
| 7-7B | 0.5 | | | | | 2.5 | SCS | 0.5 | TG 3530 | 0.5 |
| 7-8B | 0.5 | | | | | 2.5 | SCS | 0.5 | none | |
| 7-9B | 0.5 | | | | | 2.5 | none | | TG 3530 | 0.5 |
| 7-10B | 0.5 | Alum | 2.5 | | | 2.5 | SCS | 0.5 | TG 3530 | 0.5 |
| 7-11B | 0.5 | Alum | 2.5 | | | 2.5 | SCS | 0.5 | none | |
| 7-12B | 0.5 | Alum | 2.5 | | | 2.5 | none | | TG 3530 | 0.5 |
| 7-13B | | A80N | as req | | | 1.55 | SCS | 0.5 | TG 3530 | 0.5 |
| 7-14B | | A80N | as req | | | 1.55 | SCS | 0.5 | none | |
| 7-15B | | A80N | as req | | | 1.55 | none | | TG 3530 | 0.5 |
| 7-16B | | A80N | as req | TG3530 | 0.5 | 1.55 | SCS | 0.5 | TG 3530 | 0.5 |
| 7-17B | | A80N | as req | TG3530 | 0.5 | 1.55 | SCS | 0.5 | none | |
| 7-18B | | A80N | as req | TG3530 | 0.5 | 1.55 | none | | TG 3530 | 0.5 |

TABLE 14

Color Change Measurements

| | Visual Ratings Using ISO 105-A02 | | | | | | | ΔE Values Measured By Colorimeter | | | | | |
|---|---|---|---|---|---|---|---|---|---|---|---|---|---|
| Sample | 20% Clor | AR40 | Amm | Caustic 10 | Must | Total | WR | 20% Clor | AR40 | Amm | Caustic 10 | Must | Total |
| 7-1B | 2.5 | 4 | 3 | 1.5 | 1.5 | 12.5 | P | 6.21 | 1.53 | 6.96 | 18.76 | 30.73 | 64.19 |
| 7-2B | 2 | 2 | 2.5 | 1 | 1 | 8.5 | F | 13.17 | 12.81 | 8.48 | 24.17 | 67.56 | 126.19 |
| 7-3B | 1.5 | 3 | 2.5 | 0.75 | 1 | 8.75 | P | 7.99 | 8.37 | 10.78 | 28.69 | 30 | 85.83 |
| 7-4B | 4 | 4.5 | 5 | 4 | 3.5 | 21 | P | 5.14 | 1.49 | 1.15 | 2.5 | 5.24 | 15.52 |
| 7-5B | 2 | 2.5 | 5 | 2 | 1.5 | 13 | F | 9.47 | 5.39 | 2.33 | 11.78 | 34.16 | 63.13 |
| 7-6B | 2 | 4.5 | 3.5 | 1 | 3 | 14 | P | 13.64 | 1.9 | 6.97 | 26.38 | 9.1 | 57.99 |
| 7-7B | 3 | 3.5 | 2 | 1.5 | 2.5 | 12.5 | P | 8.95 | 2.78 | 10.24 | 16.07 | 11.43 | 49.47 |
| 7-8B | 2.5 | 3 | 3 | 1 | 1.5 | 11 | F | 9.45 | 6.51 | 9.89 | 25.9 | 31.9 | 83.65 |
| 7-9B | 2.5 | 1.5 | 2 | 1.5 | 2.5 | 10 | P | 6.83 | 37.6 | 15.12 | 15.36 | 12.26 | 87.17 |
| 7-10B | 2.5 | 3.5 | 2.5 | 2 | 2.5 | 13 | P | 10.9 | 3.78 | 8.55 | 12.63 | 8.36 | 44.22 |
| 7-11B | 2 | 3 | 2.5 | 1.5 | 1.5 | 10.5 | F | 8.3 | 5.82 | 9.62 | 16.34 | 23.5 | 63.58 |
| 7-12B | 2 | 3 | 2 | 1.5 | 2 | 10.5 | P | 8.43 | 6.49 | 11.42 | 12.4 | 15.94 | 54.68 |
| 7-13B | 2.5 | 3 | 3 | 2 | 2 | 12.5 | P | 5 | 5.34 | 7.01 | 14.22 | 14.7 | 46.27 |
| 7-14B | 2.5 | 2 | 3 | 2 | 1.5 | 11 | F | 6.03 | 13.09 | 3.62 | 8.7 | 28.32 | 59.76 |
| 7-15B | 2.5 | 3 | 2.5 | 2 | 2.5 | 12.5 | P | 4.34 | 8.11 | 9.25 | 12.27 | 7.33 | 41.3 |
| 7-16B | 4 | 3 | 4.5 | 2 | 2.5 | 16 | P | 2.6 | 8.05 | 2.06 | 10.15 | 9.98 | 32.84 |
| 7-17B | 2.5 | 3 | 4 | 1.5 | 2.5 | 13.5 | P | 3.98 | 7.22 | 5.17 | 19.74 | 17 | 53.11 |
| 7-18B | 2.5 | 3.5 | 2.5 | 1.5 | 3 | 13 | P | 2.23 | 2.9 | 8.91 | 22.88 | 4.67 | 41.59 |
| Total | 45 | 55.5 | 55 | 30.25 | 38 | 223.75 | | 132.66 | 139.18 | 137.53 | 298.94 | 362.18 | 1070.49 |
| Average | 2.5 | 3.1 | 3.1 | 1.7 | 2.1 | 12.4 | | 7.4 | 7.7 | 7.6 | 16.6 | 20.1 | 59.5 |
| Control | 1 | 1 | 5 | 5 | 1 | 13 | F | 7.8 | 34.2 | 0.38 | 0.33 | 70.5 | 113.21 |

As shown in Table 14, ΔE values for samples that were treated topically using the combination of a fluorochemical and a crosslinking agent (i.e., Samples 7-1A, 7-4A, 7-7A, 7-10A, 7-13A, and 7-16A) were in almost every case lower than ΔE values for the associated samples that were not topically treated with the combination of both a fluorochemical compound and a crosslinking agent.

Example 8

Application of Tannic Acid-Containing Treatment Compositions

Example 6 was repeated except that tannic acid CLM was used in place of tannic acid ASP. Process variables for Example 8 are shown in Table 15 below. Discoloration results are shown in Table 16 below.

TABLE 15

Aftertreatment and Topical Spray Treatments

| | Aftertreatment Composition Components and Percent On Weight of Fiber | | | | | | | |
|---|---|---|---|---|---|---|---|---|
| Sample | Aftertreat | C1 | % owf | C2 | % owf | C3 | % owf | C4 |
| 8-1C | Ahiba | CLM | 1.6 | Citric Acid | as req | | | |
| 8-2C | Ahiba | CLM | 1.6 | Citric Acid | as req | | | |
| 8-3C | Ahiba | CLM | 1.6 | Citric Acid | as req | | | |
| 8-4C | Ahiba | CLM | 0.4 | APT | 0.15 | AP63 | 3.5 | |
| 8-5C | Ahiba | CLM | 0.4 | APT | 0.15 | AP63 | 3.5 | |
| 8-6C | Ahiba | CLM | 0.4 | APT | 0.15 | AP63 | 3.5 | |
| 8-7C | Continuous | CLM | 2.5 | Eulysine S | as req | Acetic 80 | 0.5 | Isoprop |
| 8-8C | Continuous | CLM | 2.5 | Eulysine S | as req | Acetic 80 | 0.5 | Isoprop |
| 8-9C | Continuous | CLM | 2.5 | Eulysine S | as req | Acetic 80 | 0.5 | Isoprop |
| 8-10C | Continuous | CLM | 2.5 | Eulysine S | as req | Acetic 80 | 0.5 | Isoprop |
| 8-11C | Continuous | CLM | 2.5 | Eulysine S | as req | Acetic 80 | 0.5 | Isoprop |
| 8-12C | Continuous | CLM | 2.5 | Eulysine S | as req | Acetic 80 | 0.5 | Isoprop |
| 8-13C | Continuous | CLM | 0.4 | | | AP63 | 1 | |
| 8-14C | Continuous | CLM | 0.4 | | | AP63 | 1 | |
| 8-15C | Continuous | CLM | 0.4 | | | AP63 | 1 | |
| 8-16C | Continuous | CLM | 0.4 | | | AP63 | 1 | |
| 8-17C | Continuous | CLM | 0.4 | | | AP63 | 1 | |
| 8-18C | Continuous | CLM | 0.4 | | | AP63 | 1 | |

| | Aftertreatment Composition Components and Percent On Weight of Fiber | | | | | | Topical Spray Composition Components and Percent On Weight of Fiber | | | |
|---|---|---|---|---|---|---|---|---|---|---|
| Sample | % owf | C5 | % owf | C6 | % owf | pH | C1 | % owf | C2 | % owf |
| 8-1C | | | | | | 4 | SCS | 0.5 | TG 3530 | 0.5 |
| 8-2C | | | | | | 4 | SCS | 0.5 | none | |
| 8-3C | | | | | | 4 | none | | TG 3530 | 0.5 |
| 8-4C | | A80N | as req | | | 2.2 | SCS | 0.5 | TG 3530 | 0.5 |
| 8-5C | | A80N | as req | | | 2.2 | SCS | 0.5 | none | |
| 8-6C | | A80N | as req | | | 2.2 | none | | TG 3530 | 0.5 |
| 8-7C | 0.5 | | | | | 2.5 | SCS | 0.5 | TG 3530 | 0.5 |
| 8-8C | 0.5 | | | | | 2.5 | SCS | 0.5 | none | |
| 8-9C | 0.5 | | | | | 2.5 | none | | TG 3530 | 0.5 |
| 8-10C | 0.5 | Alum | 2.5 | | | 2.5 | SCS | 0.5 | TG 3530 | 0.5 |
| 8-11C | 0.5 | Alum | 2.5 | | | 2.5 | SCS | 0.5 | none | |
| 8-12C | 0.5 | Alum | 2.5 | | | 2.5 | none | | TG 3530 | 0.5 |
| 8-13C | | A80N | as req | | | 1.55 | SCS | 0.5 | TG 3530 | 0.5 |
| 8-14C | | A80N | as req | | | 1.55 | SCS | 0.5 | none | |
| 8-15C | | A80N | as req | | | 1.55 | none | | TG 3530 | 0.5 |
| 8-16C | | A80N | as req | TG 3530 | 0.5 | 1.55 | SCS | 0.5 | TG 3530 | 0.5 |
| 8-17C | | A80N | as req | TG 3530 | 0.5 | 1.55 | SCS | 0.5 | none | |
| 8-18C | | A80N | as req | TG 3530 | 0.5 | 1.55 | none | | TG 3530 | 0.5 |

TABLE 16

| Color Change Measurements | | | | | | | | | | | | | |
|---|---|---|---|---|---|---|---|---|---|---|---|---|---|
| | Visual Ratings Using ISO 105-A02 | | | | | | | ΔE Values Measured By Colorimeter | | | | | |
| Sample | 20% Clor | AR40 | Amm | Caustic 10 | Must | Total | WR | 20% Clor | AR40 | Amm | Caustic 10 | Must | Total |
| 8-1C | 2.5 | 4.5 | 2.5 | 1.5 | 2 | 13 | P | 12.2 | 0.548 | 8.72 | 15.22 | 18.9 | 55.6 |
| 8-2C | 2 | 3.5 | 2.5 | 1.5 | 1 | 10.5 | F | 9.84 | 3.48 | 6.36 | 20.72 | 46.85 | 87.3 |
| 8-3C | 2.5 | 3.5 | 2.5 | 1 | 1.5 | 11 | P | 7.02 | 3.92 | 8.13 | 25.39 | 34.47 | 78.9 |
| 8-4C | 3 | 4.5 | 4.5 | 2.5 | 3 | 17.5 | P | 4.78 | 0.26 | 3.22 | 6.42 | 6.93 | 21.6 |
| 8-5C | 2 | 3 | 4.5 | 1.5 | 1.5 | 12.5 | F | 8.43 | 5.14 | 1.37 | 12.31 | 26.69 | 53.9 |
| 8-6C | 1 | 4.5 | 4.5 | 1.5 | 2.5 | 14 | P | 9.08 | 0.66 | 3.89 | 21.07 | 15.49 | 50.2 |
| 8-7C | 2 | 3.5 | 2.5 | 1.5 | 3.5 | 13 | P | 7.4 | 4.71 | 8.37 | 15.33 | 5.48 | 41.3 |
| 8-8C | 1.5 | 2.5 | 2 | 1 | 1.5 | 8.5 | F | 10.07 | 5.49 | 8.79 | 24.82 | 30.24 | 79.4 |
| 8-9C | 2 | 1.5 | 2 | 1.5 | 3 | 10 | P | 5.52 | 28.97 | 7.36 | 14.02 | 11.84 | 67.7 |
| 8-10C | 2 | 3 | 2.5 | 2 | 3.5 | 13 | P | 9.18 | 7.21 | 7.56 | 19.29 | 5.81 | 49.1 |
| 8-11C | 2 | 2 | 2 | 1.5 | 2 | 9.5 | F | 8.99 | 11.23 | 8.53 | 17.3 | 23.76 | 69.8 |
| 8-12C | 1.5 | 2 | 2 | 2 | 3.5 | 11 | P | 9.65 | 10.39 | 10.1 | 11.23 | 5.31 | 46.7 |
| 8-13C | 2.5 | 2.5 | 3 | 1.5 | 4 | 13.5 | P | 9.42 | 10.37 | 5.69 | 19.19 | 3.17 | 47.8 |
| 8-14C | 2 | 2.5 | 3.5 | 1.5 | 1.5 | 11 | F | 9.9 | 5.93 | 4.12 | 17.55 | 26.19 | 63.7 |
| 8-15C | 1 | 2.5 | 2 | 1.5 | 3.5 | 10.5 | P | 5.35 | 6.64 | 7.73 | 21.56 | 4.18 | 45.5 |
| 8-16C | 2.5 | 2.5 | 4 | 2 | 3.5 | 14.5 | P | 3.8 | 10.45 | 4.58 | 11.58 | 8.1 | 38.5 |
| 8-17C | 1 | 2.5 | 4 | 1.5 | 3 | 12 | P | 2.91 | 4.85 | 3.43 | 17.13 | 8.68 | 37.0 |
| 8-18C | 1 | 3 | 2 | 1.5 | 3.5 | 11 | P | 5.12 | 4.7 | 9.94 | 19.84 | 2.25 | 41.9 |
| Total | 34 | 53.5 | 52.5 | 28.5 | 47.5 | 216 | | 138.66 | 124.948 | 117.89 | 309.97 | 284.34 | 975.808 |
| Average | 1.9 | 3.0 | 2.9 | 1.6 | 2.6 | 12.0 | | 7.7 | 6.9 | 6.5 | 17.2 | 15.8 | 54.2 |
| Control | 1 | 1 | 5 | 5 | 1 | 13 | F | 7.8 | 34.2 | 0.38 | 0.33 | 70.5 | 113.21 |

As shown in Table 16, ΔE values for samples that were treated topically using the combination of a fluorochemical and a crosslinking agent of the present invention (i.e., Samples 8-1A, 8-4A, 8-7A, 8-10A, 8-13A, and 8-16A) were in almost every case lower than ΔE values for the associated samples that were not topically treated with the combination of both a fluorochemical compound and a crosslinking agent.

Example 9

Application of Tannic Acid-Containing Treatment Compositions

Example 9 was repeated except that BAYGARD® CL tannic acid solution was used in place of tannic acid ASP. Process variables for Example 9 are shown in Table 17 below. Discoloration results are shown in Table 18 below.

TABLE 17

| Aftertreatment and Topical Spray Treatments | | | | | | | | |
|---|---|---|---|---|---|---|---|---|
| | Aftertreatment Composition Components and Percent On Weight of Fiber | | | | | | | |
| Sample | Aftertreat | C1 | % owf | C2 | % owf | C3 | % owf | C4 |
| 9-1D | Ahiba | Bay Cl L | 4.8 | Citric Acid | as req | | | |
| 9-2D | Ahiba | Bay Cl L | 4.8 | Citric Acid | as req | | | |
| 9-3D | Ahiba | Bay Cl L | 4.8 | Citric Acid | as req | | | |
| 9-4D | Ahiba | Bay Cl L | 1.2 | APT | 0.15 | AP63 | 3.5 | |
| 9-5D | Ahiba | Bay Cl L | 1.2 | APT | 0.15 | AP63 | 3.5 | |
| 9-6D | Ahiba | Bay Cl L | 1.2 | APT | 0.15 | AP63 | 3.5 | |
| 9-7D | Continuous | Bay Cl L | 7.5 | Eulysine S | as req | Acetic 80 | 0.5 | Isoprop |
| 9-8D | Continuous | Bay Cl L | 7.5 | Eulysine S | as req | Acetic 80 | 0.5 | Isoprop |
| 9-9D | Continuous | Bay Cl L | 7.5 | Eulysine S | as req | Acetic 80 | 0.5 | Isoprop |
| 9-10D | Continuous | Bay Cl L | 7.5 | Eulysine S | as req | Acetic 80 | 0.5 | Isoprop |
| 9-11D | Continuous | Bay Cl L | 7.5 | Eulysine S | as req | Acetic 80 | 0.5 | Isoprop |
| 9-12D | Continuous | Bay Cl L | 7.5 | Eulysine S | as req | Acetic 80 | 0.5 | Isoprop |
| 9-13D | Continuous | Bay Cl L | 1.2 | | | AP63 | 1 | |
| 9-14D | Continuous | Bay Cl L | 1.2 | | | AP63 | 1 | |

TABLE 17-continued

| Aftertreatment and Topical Spray Treatments | | | | | |
|---|---|---|---|---|---|
| 9-15D | Continuous | Bay Cl L | 1.2 | AP63 | 1 |
| 9-16D | Continuous | Bay Cl L | 1.2 | AP63 | 1 |
| 9-17D | Continuous | Bay Cl L | 1.2 | AP63 | 1 |
| 9-18D | Continuous | Bay Cl L | 1.2 | AP63 | 1 |

| | Aftertreatment Composition Components and Percent On Weight of Fiber | | | | | | Topical Spray Composition Components and Percent On Weight of Fiber | | | |
|---|---|---|---|---|---|---|---|---|---|---|
| Sample | % owf | C5 | % owf | C6 | % owf | pH | C1 | % owf | C2 | % owf |
| 9-1D | | | | | | 4 | SCS | 0.5 | TG 3530 | 0.5 |
| 9-2D | | | | | | 4 | SCS | 0.5 | none | |
| 9-3D | | | | | | 4 | none | | TG 3530 | 0.5 |
| 9-4D | | A80N | as req | | | 2.2 | SCS | 0.5 | TG 3530 | 0.5 |
| 9-5D | | A80N | as req | | | 2.2 | SCS | 0.5 | none | |
| 9-6D | | A80N | as req | | | 2.2 | none | | TG 3530 | 0.5 |
| 9-7D | 0.5 | | | | | 2.5 | SCS | 0.5 | TG 3530 | 0.5 |
| 9-8D | 0.5 | | | | | 2.5 | SCS | 0.5 | none | |
| 9-9D | 0.5 | | | | | 2.5 | none | | TG 3530 | 0.5 |
| 9-10D | 0.5 | Alum | 2.5 | | | 2.5 | SCS | 0.5 | TG 3530 | 0.5 |
| 9-11D | 0.5 | Alum | 2.5 | | | 2.5 | SCS | 0.5 | none | |
| 9-12D | 0.5 | Alum | 2.5 | | | 2.5 | none | | TG 3530 | 0.5 |
| 9-13D | | A80N | as req | | | 1.55 | SCS | 0.5 | TG 3530 | 0.5 |
| 9-14D | | A80N | as req | | | 1.55 | SCS | 0.5 | none | |
| 9-15D | | A80N | as req | | | 1.55 | none | | TG 3530 | 0.5 |
| 9-16D | | A80N | as req | TG3530 | 0.5 | 1.55 | SCS | 0.5 | TG 3530 | 0.5 |
| 9-17D | | A80N | as req | TG3530 | 0.5 | 1.55 | SCS | 0.5 | none | |
| 9-18D | | A80N | as req | TG3530 | 0.5 | 1.55 | none | | TG 3530 | 0.5 |

TABLE 18

| | Color Change Measurements | | | | | | | | | | | | |
|---|---|---|---|---|---|---|---|---|---|---|---|---|---|
| | Visual Ratings Using ISO 105-A02 | | | | | | | ΔE Values Measured By Colorimeter | | | | | |
| Sample | 20% Clor | AR40 | Amm | Caustic 10 | Must | Total | WR | 20% Clor | AR40 | Amm | Caustic 10 | Must | Total |
| 9-1D | 2 | 4 | 2.5 | 1.5 | 1.5 | 11.5 | P | 16.44 | 2.27 | 10.36 | 20.48 | 21.47 | 71.02 |
| 9-2D | 2 | 3.5 | 2.5 | 1 | 1 | 10 | F | 12.5 | 3.29 | 7.39 | 20.84 | 56.64 | 100.66 |
| 9-3D | 2 | 2.5 | 2.5 | 1 | 1.5 | 9.5 | P | 5.54 | 13.29 | 6.28 | 13.72 | 20.87 | 59.7 |
| 9-4D | 3.5 | 5 | 5 | 2 | 3 | 18.5 | P | 3.72 | 0.48 | 3.38 | 10.05 | 8.84 | 26.47 |
| 9-5D | 2.5 | 3.5 | 5 | 2 | 2 | 15 | F | 8.58 | 3.45 | 1.8 | 13.49 | 14.18 | 41.5 |
| 9-6D | 1 | 4.5 | 4.5 | 1 | 2.5 | 13.5 | P | 10.18 | 0.85 | 4.27 | 16.86 | 6.21 | 38.37 |
| 9-7D | 2 | 3.5 | 2.5 | 1 | 4 | 13 | P | 9.42 | 4.49 | 7.66 | 24.31 | 2.14 | 48.02 |
| 9-8D | 2 | 3 | 2 | 1 | 2.5 | 10.5 | P | 9.33 | 5.68 | 9.85 | 29.32 | 9.3 | 63.48 |
| 9-9D | 2 | 4 | 2 | 1 | 4 | 13 | P | 8.13 | 2.16 | 11.52 | 26.71 | 5.18 | 53.7 |
| 9-10D | 2 | 2.5 | 2.5 | 1.5 | 4 | 12.5 | P | 14.39 | 5.91 | 10.52 | 25.38 | 5.72 | 61.92 |
| 9-11D | 2 | 1.5 | 2.5 | 1.5 | 1.5 | 9 | F | 6.98 | 10.73 | 3.76 | 16.5 | 23.39 | 61.36 |
| 9-12D | 1.5 | 2 | 2 | 1 | 4 | 10.5 | P | 8.6 | 10.71 | 8.68 | 16.07 | 3.56 | 47.62 |
| 9-13D | 2.5 | 2.5 | 4.5 | 2 | 4 | 15.5 | P | 9.81 | 9.1 | 1.65 | 15.17 | 5.43 | 41.16 |
| 9-14D | 2 | 2.5 | 4.5 | 2 | 2 | 13 | F | 9.73 | 9.46 | 3.18 | 17.35 | 22.32 | 62.04 |
| 9-15D | 1 | 2.5 | 3.5 | 1 | 4 | 12 | P | 5.59 | 6.49 | 8.44 | 29.96 | 7.25 | 57.73 |
| 9-16D | 2.5 | 2.5 | 4 | 3 | 3.5 | 15.5 | P | 4.8 | 10.34 | 3.08 | 13.13 | 7.46 | 38.81 |
| 9-17D | 1.5 | 2.5 | 4.5 | 2 | 3 | 13.5 | P | 2.91 | 7.44 | 2.6 | 11.86 | 7.68 | 32.49 |
| 9-18D | 1.5 | 3.5 | 3 | 2 | 4 | 14 | P | 4.65 | 4.45 | 7.02 | 13.77 | 4.57 | 34.46 |
| Total | 35.5 | 55.5 | 59.5 | 27.5 | 52 | 230 | | 151.3 | 110.59 | 111.44 | 334.97 | 232.21 | 940.51 |
| Average | 2.0 | 3.1 | 3.3 | 1.5 | 2.9 | 12.8 | | 8.4 | 6.1 | 6.2 | 18.6 | 12.9 | 52.3 |
| Control | 1 | 1 | 5 | 5 | 1 | 13 | F | 7.8 | 34.2 | 0.38 | 0.33 | 70.5 | 113.21 |

As shown in Table 18, ΔE values for samples that were treated topically using the combination of a fluorochemical and a crosslinking agent (i.e., Samples 9-1A, 9-4A, 9-7A, 9-10A, 9-13A, and 9-16A) were in almost every case lower than ΔE values for the associated samples that were not topically treated with the combination of both a fluorochemical compound and a crosslinking agent.

Example 10

Application of Tannic Acid-Containing Treatment Compositions Using Various Fluorochemical Compounds Carpet sample comprising greige 2099 were dyed using the above-described dyebath composition. The carpet samples were dyed using an Ahiba dyeing process as described above. The carpet samples were then subjected to an aftertreatment composition and a topical spray composition using a continuous process as described above. Process variables are shown in Table 19 below.

The total wet pick-up during the aftertreatment step was about 400 wt % for each sample. The total steam time for each sample was 180 seconds. The total wet pick-up during the topical spray step was about 40 wt % for each sample.

Following the treatment steps, each sample was tested for discoloration using (i) the visual gray scale rating system, and (ii) color difference values (ΔE) as measured using a Macbeth 20/20 contact spectrophotometer. The results are shown in Table 20 below.

TABLE 19

Aftertreatment and Topical Spray Treatments

| | | Aftertreatment Composition Components and Percent On Weight of Fiber | | | | | | | | | | | | | Topical Spray Composition Components and Percent On Weight of Fiber | | | |
|---|---|---|---|---|---|---|---|---|---|---|---|---|---|---|---|---|---|---|
| Sample | Aftertreat | C1 | % owf | C2 | % owf | C3 | % owf | C4 | % owf | C5 | % owf | C6 | % owf | pH | C1 | % owf | C2 | % owf |
| 10-1 | Continuous | ASP | 0.4 | APT | 0.15 | AP63 | 1 | | | A80N | as req | M50C | 0.5 | 1.55 | SCS | 0 | M50C | 0.5 |
| 10-2 | Continuous | ASP | 0.4 | APT | 0.15 | AP63 | 1 | | | A80N | as req | M50D | 0.5 | 1.55 | SCS | 0 | M50D | 0.5 |
| 10-3 | Continuous | ASP | 0.4 | APT | 0.15 | AP63 | 1 | | | A80N | as req | TG 3530 | 0.25 | 1.55 | SCS | 0.5 | TG 3530 | 0.25 |
| 10-4 | Continuous | ASP | 0.4 | APT | 0.15 | AP63 | 1 | | | A80N | as req | TG 3360 | 0.25 | 1.55 | SCS | 0.25 | TG 3360 | 0.25 |
| 10-5 | Continuous | ASP | 0.4 | APT | 0.15 | AP63 | 1 | | | A80N | as req | N119 | 0.25 | 1.55 | SCS | 0.1 | N119 | 0.25 |
| 10-6 | Continuous | ASP | 0.4 | APT | 0.15 | AP63 | 1 | | | A80N | as req | N140 | 0.5 | 1.55 | SCS | 0.1 | N140 | 0.5 |
| 10-7 | Continuous | ASP | 0.4 | APT | 0.15 | AP63 | 1 | | | A80N | as req | PM 1451 | 0.5 | 1.55 | SCS | 0 | PM 1451 | 0.5 |
| 10-8 | Continuous | ASP | 0.4 | APT | 0.15 | AP63 | 1 | | | A80N | as req | PM 1396 | 0.5 | 1.55 | SCS | 0.25 | PM 1396 | 0.5 |
| 10-9 | Continuous | ASP | 0.4 | APT | 0.15 | AP63 | 1 | | | A80N | as req | Nuva 2042 | 0.25 | 1.55 | SCS | 0.5 | Nuva 2042 | 0.25 |
| 10-10 | Continuous | ASP | 0.4 | APT | 0.15 | AP63 | 1 | | | A80N | as req | Nuva STU | 0.25 | 1.55 | SCS | 0.13 | Nuva STU | 0.25 |
| 10-11 | Continuous | ASP | 0.4 | APT | 0.15 | AP63 | 1 | | | A80N | as req | TG 472 | 0.25 | 1.55 | SCS | 0.5 | TG 472 | 0.25 |
| 10-12 | Continuous | ASP | 0.4 | APT | 0.15 | AP63 | 1 | | | A80N | as req | Bay AS | 1 | 1.55 | SCS | 0.5 | Bay AS | 1 |

TABLE 20

Color Change Measurements

| | Visual Ratings Using ISO 105-A02 | | | | | | | ΔE Values Measured By Colorimeter | | | | | |
|---|---|---|---|---|---|---|---|---|---|---|---|---|---|
| Sample | 20% Clor | AR40 | Amm | Caustic 10 | Must | Total | WR | 20% Clor | AR40 | Amm | Caustic 10 | Must | Total |
| 10-1 | 1 | 4 | 4.5 | 1 | 2.5 | 13 | P | 5.67 | 1.7 | 2.59 | 28.28 | 1.29 | 39.53 |
| 10-2 | 1 | 3.5 | 5 | 1.5 | 2.5 | 13.5 | P | 5.76 | 2.32 | 1.06 | 19.67 | 8.23 | 37.04 |
| 10-3 | 3 | 3.5 | 4.5 | 3 | 2.5 | 16.5 | P | 2.86 | 3.41 | 2.25 | 4.46 | 11.11 | 24.09 |
| 10-4 | 3.5 | 4 | 4.5 | 3 | 2.5 | 17.5 | P | 2.74 | 2.41 | 1.59 | 7.3 | 13 | 27.04 |
| 10-5 | 1 | 3.5 | 4 | 1 | 2 | 11.5 | F | 7.13 | 2.07 | 4.72 | 21.95 | 16.5 | 52.37 |
| 10-6 | 1 | 4 | 4.5 | 1 | 1.5 | 12 | F | 8.61 | 2.99 | 3.86 | 22.48 | 30.12 | 68.06 |
| 10-7 | 1.5 | 3.5 | 4.5 | 1 | 1.5 | 12 | F | 6.76 | 5.59 | 4.38 | 26.13 | 31.22 | 74.08 |
| 10-8 | 1.5 | 4 | 4.5 | 1.5 | 1.5 | 13 | P | 6.09 | 1.2 | 1.15 | 11.11 | 23.45 | 43 |
| 10-9 | 2.5 | 3 | 4.5 | 2 | 1.5 | 13.5 | P | 3.35 | 3.79 | 2.9 | 8.92 | 23.84 | 42.8 |
| 10-10 | 2 | 3 | 4.5 | 1 | 1.5 | 12 | F | 9.39 | 2.03 | 3.62 | 18.45 | 41.28 | 74.77 |
| 10-11 | 2.5 | 3.5 | 4.5 | 2 | 2.5 | 15 | P | 3.52 | 2.93 | 2.8 | 5.99 | 14.86 | 30.1 |
| 10-12 | 2 | 2 | 4.5 | 1.5 | 1 | 11 | F | 10 | 13.35 | 2.48 | 12.68 | 60.74 | 99.25 |
| Total | 22.5 | 41.5 | 54 | 19.5 | 23 | 160.5 | 71.88 | 43.79 | 33.4 | 187.42 | 275.64 | 612.13 | 71.88 |
| Average | 1.875 | 3.5 | 4.5 | 1.6 | 1.9 | 13.4 | 5.99 | 3.6 | 2.8 | 15.6 | 23.0 | 51.0 | 5.99 |
| Control | 1 | 1 | 5 | 5 | 1 | 13 | F | 7.8 | 34.2 | 0.38 | 0.33 | 70.5 | 113.21 |

As shown in Table 20, ΔE values for samples using the fluorochemical components DAIKIN TG 3530, TG 3360, and TG 472 (i.e., Samples 10-3, 10-4 and 10-11) resulted in the lowest ΔE values.

Example 11

Application of Tannic Acid-Containing Treatment Compositions Using Various Fluorochemical Compounds Example 10 was repeated except an Ahiba process was used to apply the aftertreatment composition and the topical spray composition. Process variables are shown in Table 21 below. Discoloration results are shown in Table 22 below.

As shown in Table 22, ΔE values for samples using the fluorochemical components DAIKIN TG 3530, TG 3360 and TG 472 (i.e., Samples 11-3, 11-4 and 11-11) resulted in the lowest ΔE values.

While the specification has been described in detail with respect to specific embodiments, thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of treating fiber, yarn or carpet comprising the sequential steps of:

TABLE 21

Aftertreatment and Topical Spray Treatments

| | | Aftertreatment Composition Components and Percent On Weight of Fiber | | | | | | | | | | | | | Topical Spray Composition Components and Percent On Weight of Fiber | | | |
|---|---|---|---|---|---|---|---|---|---|---|---|---|---|---|---|---|---|---|
| Sample | After-treat | C1 | % owf | C2 | % owf | C3 | % owf | C4 | % owf | C5 | % owf | C6 | % owf | pH | C1 | % owf | C2 | % owf |
| 11-1 | Ahiba | ASP | 0.4 | APT | 0.15 | AP63 | 3.5 | | | A80N | as req | M50C | 0.5 | 1.55 | SCS | 0 | M50C | 0.5 |
| 11-2 | Ahiba | ASP | 0.4 | APT | 0.15 | AP63 | 3.5 | | | A80N | as req | M50D | 0.5 | 1.55 | SCS | 0 | M50D | 0.5 |
| 11-3 | Ahiba | ASP | 0.4 | APT | 0.15 | AP63 | 3.5 | | | A80N | as req | TG 3530 | 0.25 | 1.55 | SCS | 0.5 | TG 3530 | 0.25 |
| 11-4 | Ahiba | ASP | 0.4 | APT | 0.15 | AP63 | 3.5 | | | A80N | as req | TG 3360 | 0.25 | 1.55 | SCS | 0.25 | TG 3360 | 0.25 |
| 11-5 | Ahiba | ASP | 0.4 | APT | 0.15 | AP63 | 3.5 | | | A80N | as req | N119 | 0.25 | 1.55 | SCS | 0.1 | N119 | 0.25 |
| 11-6 | Ahiba | ASP | 0.4 | APT | 0.15 | AP63 | 3.5 | | | A80N | as req | N140 | 0.5 | 1.55 | SCS | 0.1 | N140 | 0.5 |
| 11-7 | Ahiba | ASP | 0.4 | APT | 0.15 | AP63 | 3.5 | | | A80N | as req | PM 1451 | 0.5 | 1.55 | SCS | 0 | PM 1451 | 0.5 |
| 11-8 | Ahiba | ASP | 0.4 | APT | 0.15 | AP63 | 3.5 | | | A80N | as req | PM 1396 | 0.5 | 1.55 | SCS | 0.25 | PM 1396 | 0.5 |
| 11-9 | Ahiba | ASP | 0.4 | APT | 0.15 | AP63 | 3.5 | | | A80N | as req | Nuva 2042 | 0.25 | 1.55 | SCS | 0.5 | Nuva 2042 | 0.25 |
| 11-10 | Ahiba | ASP | 0.4 | APT | 0.15 | AP63 | 3.5 | | | A80N | as req | Nuva STU | 0.25 | 1.55 | SCS | 0.13 | Nuva STU | 0.25 |
| 11-11 | Ahiba | ASP | 0.4 | APT | 0.15 | AP63 | 3.5 | | | A80N | as req | TG 472 | 0.25 | 1.55 | SCS | 0.5 | TG 472 | 0.25 |
| 11-12 | Ahiba | ASP | 0.4 | APT | 0.15 | AP63 | 3.5 | | | A80N | as req | Bay AS | 1 | 1.55 | SCS | 0.5 | Bay AS | 1 |

TABLE 22

Color Change Measurements

| | Visual Ratings Using ISO 105-A02 | | | | | | | ΔE Values Measured By Colorimeter | | | | | |
|---|---|---|---|---|---|---|---|---|---|---|---|---|---|
| Sample | 20% Clor | AR40 | Amm | Caustic 10 | Must | Total | WR | 20% Clor | AR40 | Amm | Caustic 10 | Must | Total |
| 11-1 | 2 | 2.5 | 4 | 1.5 | 1 | 11 | P | 9.4 | 3.81 | 3.8 | 21.94 | 10.62 | 49.57 |
| 11-2 | 1 | 3 | 4 | 1 | 1.5 | 10.5 | P | 9.99 | 3.1 | 5.07 | 26.44 | 24.51 | 69.11 |
| 11-3 | 3 | 4 | 4.5 | 3.5 | 1.5 | 16.5 | P | 3.01 | 1.29 | 1.7 | 5.6 | 18.21 | 29.81 |
| 11-4 | 3.5 | 4.5 | 4.5 | 4.5 | 1.5 | 18.5 | P | 2.73 | 0.67 | 1.51 | 1.18 | 21.09 | 27.18 |
| 11-5 | 2.5 | 4 | 4 | 2.5 | 1.5 | 14.5 | F | 10.74 | 2.19 | 1.79 | 11.48 | 24.74 | 50.94 |
| 11-6 | 2.5 | 4.5 | 4 | 2 | 1 | 14 | F | 9.85 | 2.1 | 3.68 | 9.24 | 22.4 | 47.27 |
| 11-7 | 1 | 4.5 | 4 | 1 | 1.5 | 12 | F | 9.05 | 1.19 | 5.21 | 22.22 | 20.84 | 58.51 |
| 11-8 | 2.5 | 4 | 4.5 | 2.5 | 2 | 15.5 | P | 5.79 | 2.71 | 1.1 | 6.94 | 17.85 | 34.39 |
| 11-9 | 2.5 | 4.5 | 4 | 3 | 1.5 | 15.5 | P | 5.97 | 1.27 | 2.91 | 2.89 | 21.03 | 34.07 |
| 11-10 | 2 | 4.5 | 4.5 | 2 | 1.5 | 14.5 | F | 4.91 | 1.68 | 1.81 | 9.2 | 26.31 | 43.91 |
| 11-11 | 3 | 4.5 | 4.5 | 4 | 2 | 18 | P | 2.75 | 1.06 | 0.49 | 2.93 | 7.67 | 14.9 |
| 11-12 | 1 | 2.5 | 4.5 | 2.5 | 1 | 11.5 | F | 4.85 | 6.63 | 0.503 | 7.57 | 36.45 | 56.003 |
| Total | 26.5 | 47 | 51 | 30 | 17.5 | 172 | | 79.04 | 27.7 | 29.573 | 127.63 | 251.72 | 515.663 |
| Average | 2.208333 | 3.9 | 4.3 | 2.5 | 1.5 | 14.3 | | 6.586667 | 2.3 | 2.5 | 10.6 | 21.0 | 43.0 |
| Control | 1 | 1 | 5 | 5 | 1 | 13 | F | 7.8 | 34.2 | 0.38 | 0.33 | 70.5 | 113.21 |

a. applying a first aqueous treating composition to fiber, yarn or carpet, wherein the first aqueous treating composition comprises tannic acid;

b. heating the fiber, yarn or carpet to a temperature of at least about 160° F.;

c. applying a second topical treating composition to the fiber, carpet or yarn, wherein the second topical treating composition comprises a fluorochemical; and d. heating the fiber, yarn or carpet to a temperature of at least about 160° F.

2. The method of claim 1, wherein the first aqueous treating composition further comprises a stain resist compound.

3. The method of claim 1, wherein the treated fiber, yarn or carpet has up to about 5.0 owf tannic acid, based on a total weight of the dried fiber, yarn or carpet.

4. The method of claim 1, wherein the heating step between the applying a first aqueous treating composition step and the applying a second topical treating composition step has a temperature of from about 160° F. to about 260° F. for a period of time ranging from about 15 seconds to about 60 minutes.

5. The method of claim 1, wherein the first aqueous treating solution further comprises:

a. a stain resist compound;

b. a fluorochemical; or c. an organosilicate material.

6. The method of claim 5, wherein the stain resist compound is present in the first aqueous treating composition and is applied to the fiber, yarn or carpet at up to about 4.0 owf.

7. The method of claim 5, wherein the stain resist compound is present in the first aqueous treating composition and is applied to the fiber, yarn or carpet at from about 0.25 to about 3.0 owf.

8. The method of claim 5, wherein the stain resist compound is present in the first aqueous treating composition and comprises:

a. a polymer or copolymer of methacrylic acid;

b. a phenolic resin;

c. styrene-maleic anhydride copolymer; or d. an aqueous emulsion of polymerized monomers, wherein the monomers comprise (meth)acrylic acid, alkyl(meth)acrylic acid, and a substituted or unsubstituted styrene.

9. The method of claim 5, wherein the fluorochemical present in the second topical treating composition is applied to the fiber, yarn or carpet in an amount ranging from about 100 to about 800 ppm, based on a total weight of the dried fiber, yarn or carpet.

10. The method of claim 9, wherein the first aqueous treating composition further comprises a crosslinking agent, stannous chloride.

11. The method of claim 1, wherein either or both of the first and second treating compositions has a pH of less than about 3.

12. The method of claim 1, wherein the first aqueous treating composition further comprises a crosslinking agent.

13. The method of claim 12, wherein the crosslinking agent in the first aqueous treating solution comprises antimony potassium tartrate.

14. The method of claim 1, wherein the second topical treating composition further comprises: a stain resist compound; one or more crosslinking agents; or-an organosilicate material.

15. The method of claim 14, wherein the stain resist compound is present in the second topical treating composition and comprises:

a. a polymer or copolymer of methacrylic acid;

b. a phenolic resin;

c. styrene-maleic anhydride copolymer; or d. an aqueous emulsion of polymerized monomers, wherein the monomers comprise (meth)acrylic acid, alkyl(meth)acrylic acid, and a substituted or unsubstituted styrene.

16. The method of claim 1, wherein the applying a first aqueous treating composition step comprises immersion, slot coating, dip coating, spray coating, pad coating, or a combination thereof.

17. The method of claim 1, wherein the applying a second topical treating composition step comprises spray coating, foam coating, or a combination thereof.

18. The method of claim 1, wherein the heating step after the applying a second topical treating composition step has a temperature of from about 160° F. to about 260° F. for a period of time of at least about 5 minutes.

19. The method of claim 1, wherein the heating step after the applying a second topical treating composition step uses dry heat.

* * * * *